US005201873A

United States Patent [19]

Kikuchi et al.

[11] Patent Number: 5,201,873

[45] Date of Patent: Apr. 13, 1993

[54] SHEET FEEDING APPARATUS HAVING THE ABILITY TO RETRACT THE SHEET SUPPLY

[75] Inventors: Yutaka Kikuchi, Kawasaki; Kazuo Takeuchi, Iwai; Ryuichi Inaba, Tokyo; Hitoshi Ishihama, Mitsukaido; Yasunori Kawakami, Shimotsuma; Akihito Nagayama, Koganei; Kenichi Horikoshi; Hideo Saito, both of Mitsukaido; Hidetaka Fukiharu, Fuchu; Fumio Asano, Noda, all of Japan

[73] Assignee: Canon Kabushiki Kaisha, Tokyo, Japan

[21] Appl. No.: 724,882

[22] Filed: Jul. 2, 1991

[30] Foreign Application Priority Data

| | | | |
|---|---|---|---|
| Jul. 4, 1990 | [JP] | Japan | 2-176744 |
| Jul. 4, 1990 | [JP] | Japan | 2-176745 |
| Jul. 4, 1990 | [JP] | Japan | 2-176746 |
| Jul. 4, 1990 | [JP] | Japan | 2-176747 |
| Jul. 4, 1990 | [JP] | Japan | 2-176748 |
| Jul. 4, 1990 | [JP] | Japan | 2-176749 |

[51] Int. Cl.[5] ..... B65H 3/44; B65H 1/12; B65H 1/24

[52] U.S. Cl. ..... 271/9; 271/117; 271/127; 271/160

[58] Field of Search ..... 271/9, 117, 126, 127, 271/160

[56] References Cited

U.S. PATENT DOCUMENTS

| | | | |
|---|---|---|---|
| 4,113,244 | 9/1978 | Ruenzi . | |
| 4,346,878 | 8/1982 | Aizawa | 271/127 |
| 4,717,139 | 1/1988 | Sootome et al. | 271/126 |
| 4,754,961 | 7/1988 | Tokuda et al. . | |
| 4,763,891 | 8/1988 | Kodama | 271/127 |
| 4,798,373 | 1/1989 | Hyltoft | 271/9 |
| 4,798,374 | 1/1989 | Ito . | |
| 4,804,997 | 2/1989 | Mizude et al. | 271/9 |
| 4,884,909 | 12/1989 | Watanabe et al. . | |
| 4,888,617 | 12/1989 | Okuzawa | 271/127 |
| 4,909,498 | 3/1990 | Rutishauser . | |
| 4,958,822 | 9/1990 | Rutishauser et al. | 271/9 |
| 4,966,356 | 10/1990 | Ohyabu et al. | 271/9 |
| 5,002,266 | 3/1991 | Kikuchi et al. | 271/9 |
| 5,052,673 | 10/1991 | Tokuda et al. | 271/127 |

FOREIGN PATENT DOCUMENTS

| | | | |
|---|---|---|---|
| 0163263 | 12/1985 | European Pat. Off. . | |
| 2347199 | 11/1977 | France . | |
| 189945 | 11/1982 | Japan | 271/127 |
| 183533 | 10/1983 | Japan | 271/126 |
| 52430 | 3/1985 | Japan | 271/126 |
| 209230 | 8/1989 | Japan | 271/117 |

*Primary Examiner*—Robert P. Olszewski
*Assistant Examiner*—Steven M. Reiss

[57] ABSTRACT

A sheet feeding apparatus with a sheet containing tray adapted to support a plurality of sheets and being shiftable between a sheet supplying position and a waiting position, a sheet supply roller for feeding out the sheet supported by the sheet containing tray at the sheet supplying position, a driving force transmitting device connected to the sheet supply roller and adapted to transmit a driving force from a drive source, and a holding device connected to the driving force transmitting device so that the sheet containing tray is shifted to the sheet supplying position by the driving force transmitted to the sheet supply roller and capable of holding the sheet containing tray at the sheet supplying position while the plurality of sheets are being supplied by the sheet supply roller.

20 Claims, 21 Drawing Sheets

SHEET FEEDING APPARATUS HAVING THE ABILITY TO RETRACT THE SHEET SUPPLY

BACKGROUND OF THE INVENTION

1. Field of the Invention

The present invention relates to a sheet feeding apparatus for feeding sheets one by one to an image forming system such as a laser beam printer, copying machine and the like.

2. Related Background Art

An example of a conventional image forming system such as a laser beam printer and a sheet feeding apparatus is shown in FIG. 26.

In FIG. 26, a laser beam printer (image forming system) includes a body frame 302, a pivotable printer front plate 305 pivotally mounted on the body frame via a hinge shaft 303. A process cartridge 306 including a photosensitive drum 307, developing device 309 and the like is removably contained within the body frame 302, and a laser beam L emitted from a laser beam scanner 310 is illuminated onto the photosensitive drum 307 to form a latent image thereon, which latent image is developed by the developing device 309 to obtain a toner image.

A sheet supply tray 312 holding sheets $P_1$ thereon is removably attached to the printer front plate 305, and the sheets $P_1$ are separated one by one by means of a sheet supply roller 381 and a separating pad 382 and are fed to a pair of regist rollers 317. The sheet $P_1$ fed from the regist rollers 317 at a predetermined timing is brought to the photosensitive drum 307, where the toner image is transferred onto the sheet. Thereafter, the sheet is fed to a fixing device 323, where the image transferred to the sheet is fixed to the sheet, and then the sheet is ejected onto an ejector tray 326 by means of a set of ejector rollers 325.

An intermediate plate 383 supporting leading end portions of the sheets $P_1$ in the sheet supply tray 312 is biased upwardly by means of a spring 385, as shown in FIG. 27. FIGS. 28 and 29 show a mechanism for urgingly engaging or disengaging the sheet $P_1$ with respect to the sheet supply roller 381. In FIGS. 28 and 29, a drive ring 393 receives a driving force from the body, and the driving force is transmitted to a drive shaft 380 integral with the sheet supply roller 381 via a control ring 390.

As shown in FIG. 28, in a condition that the drive shaft 380 is locked by a pawl 391*a* of a solenoid 391, the driving force from the drive ring 393 is not transmitted to the drive shaft 380, with the result that the sheet supply roller 381 remains stationary. A support arm 387 formed integrally with the intermediate plate 383 is pivotally mounted on a support shaft 386, and a roller 387*a* disposed on a free end of the support arm 387 is urged against a largest diameter portion of a pressure cam 389 fixed to the drive shaft 380.

When the solenoid 391 is activated by an electric circuit 392, the pawl 391*a* is disengaged from the control ring 390, with the result that the driving force of the drive ring 393 is transmitted to the drive shaft 380. When the sheet supply roller 381 integral with the drive shaft 380 and the pressure cam 389 are rotated in the direction shown by the arrow, as shown in FIG. 29, the roller 387*a* is engaged by the smaller diameter portion of the pressure cam 389 to rise upwardly, with the result that the sheets $P_1$ on the intermediate plate 383 are urged against the sheet supply roller 381 and are fed by the sheet supply roller 381.

When the projection of the drive ring 393 is engaged and locked by the pawl 391*a* again after one revolution thereof, the sheet supply roller 381 is stopped and at the same time the support arm 387 returns to the condition shown in FIG. 28, with the result that the engagement between the sheet $P_1$ and the sheet supply roller 381 is released.

However, in the above-mentioned conventional sheet feeding apparatus, the following problems arose. (1). Between an outer diameter of the sheet supply roller 381 and a sheet path length $l_1$ extending from the sheet supply roller 381 to the paired regist rollers 317, the physical regulation or limitation $D\pi > l_1 > (D\pi - \alpha)$ arises (where, $\alpha$=about 0~15; D=diameter of roller). That is to say, the sheet path length $l_1$ is limited by the outer diameter of the sheet supply roller 381, or the outer diameter of the sheet supply roller 381 must be increased to maintain the adequate sheet path length $l_1$, thereby making the apparatus bulky. (2) Whenever each sheet is supplied, the intermediate plate 383 must be lifted and lowered once via the support arm 387 through one revolution of the pressure cam 389. (3) Since the support arm 387 must be lifted, the profile of the pressure cam 389 has an abruptly inclined portion 389*a*, with the result that the impact between the intermediate plate 383 and the sheet supply roller 381 generates a noise. (4) Since the drive shaft 380 is integrally formed with the sheet supply roller 381, the paired regist rollers 317 are subjected to a considerable back tension. (5) Due to the above reasons (1)-(3), the sheet stacking ability is limited to some extent.

SUMMARY OF THE INVENTION

An object of the present invention is to provide a sheet feeding apparatus wherein there is no need to control the shifting of an intermediate plate whenever each sheet is supplied.

In order to achieve the above object, the sheet feeding apparatus according to the present invention comprises a sheet containing means adapted to support sheets and capable of shifting between a sheet supplying position and a waiting position; a sheet supply means for feeding out the sheet supported by the sheet containing means at the sheet supplying position; a driving force transmitting means connected to the sheet supply means and adapted to transmit a driving force from a drive source; and a holding means connected to the driving force transmitting means so that the sheet containing means is shifted to the sheet supplying position by the driving force transmitted to the sheet supply means and capable of holding the sheet containing means at the sheet supplying position.

With this arrangement, the sheet containing means can be held at the sheet supplying position by utilizing the driving force (from the drive source) for driving the sheet supply means, and the impact noise which may be generated whenever each sheet is supplied can be prevented.

More particularly, the sheet containing means is constituted by a pivotable intermediate plate for supporting the sheets, and an elastic member for biasing the intermediate plate to the sheet supplying position. The holding means serves to regulate the intermediate plate to the waiting position by means of a cam means in opposition to the biasing force of the elastic member, and to receive the driving force from the driving force transmitting means so that the regulation of the intermediate plate is released, thereby shifting the intermediate plate from the waiting position to the sheet supplying position through the biasing force of the elastic member. When the intermediate plate is positioned in the sheet supplying position, a regulating means regulates the operation of the cam means.

Further, the regulating means is constituted by a first gear having no gear portion and connected to the cam means, a second gear connected to the driving force transmitting means and capable of meshing with the first gear, and a stop means for stopping the first gear to a predetermined position so that the second gear is positioned at the no gear portion of the first gear to regulate the operation of the cam means.

Another object of the present invention is to provide a sheet feeding apparatus wherein it is not needed to control the shifting movement of the intermediate plate whenever each sheet is supplied and the number of revolutions of the sheet supply means can be freely set in correspondence to the sheet path.

In order to achieve the above object, the sheet feeding apparatus according to the present invention comprises a sheet containing means adapted to support sheets and capable of shifting between a sheet supplying position and a waiting position; a sheet supply means for feeding out the sheet supported by the sheet containing means at the sheet supplying position; a driving force transmitting means connected to the sheet supply means and adapted to transmit a driving force from a drive source; a connection means for connecting and disconnecting between the driving force transmitting means and the sheet supply means; a holding means connected to the driving force transmitting means so that the sheet containing means is shifted to the sheet supplying position by the driving force transmitted to the sheet supply means and capable of holding the sheet containing means at the sheet supplying position; and a control means for controlling the operations of the connection means and of the holding means.

With this arrangement, the sheet containing means can be held at the sheet supplying position by utilizing the driving force (from the drive source) for driving the sheet supply means, and the impact noise which may be generated whenever each sheet is supplied can be prevented. Further, by properly transmitting the driving force from the driving force transmitting means to the sheet supply means through the connection means, since the feeding-out action of the sheet supply means can be freely set regardless of the position of the sheet containing means, the sheet can positively be fed out in response to the sheet path length.

More particularly, the connection means comprises a spring clutch interposed between the sheet supply means and the driving force transmitting means, and a circuit means for turning the spring clutch ON or OFF. By using this spring clutch, ON/OFF of the spring clutch can be controlled in response to the sheet path length to feed out the sheet by an appropriate length.

DETAILED DESCRIPTION OF THE PREFERRED EMBODIMENTS

The present invention will now be explained in connection with embodiments thereof with reference to the accompanying drawings.

Figure 1:
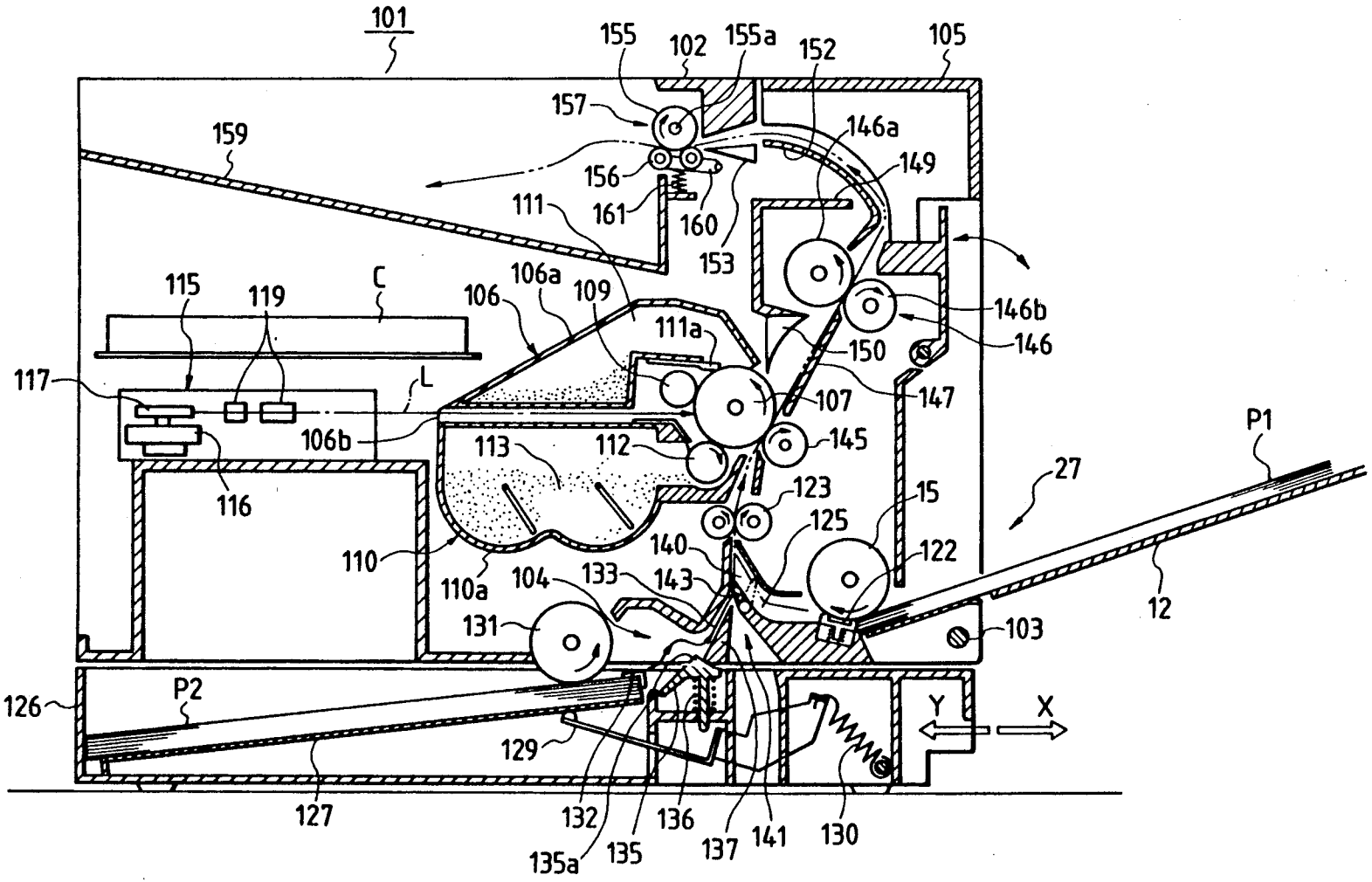
FIG. 1 is an elevational sectional view of a laser beam printer as an image forming system to which the present invention is applied.

FIG. 1 is an elevational sectional view of a laser beam printer (image forming system) 101 to which the present invention is applied. In FIG. 1, a right side is a front side of the laser beam printer 101.

The laser beam printer 101 has a body frame 102, and a pivotable printer front plate 105 pivotally mounted on the body frame by means of a hinge shaft 103. A process cartridge 106 including a photosensitive drum 107 rotated in a direction shown by the arrow, a primary charger 109 for uniformly charging the photosensitive drum 107, a developing device 110 and a cleaner 111 having a cleaning blade 111*a* is contained within the body frame 302. The developing device 110 comprises a developing sleeve 112, a developer container 110*a* containing toner 113 therein and the like.

The photosensitive drum 107 of the process cartridge 106 is exposed by a laser beam L passing through an opening 106*b* formed in an outer cover 106*a* to form a latent image thereon. A laser scanner 115 for emitting the laser beam L is constituted by a scanner motor 116, a polygonal mirror 117, a lens 119 and the like, and serves to expose the photosensitive drum 107 by illuminating the laser beam L onto the photosensitive drum in response to image information. When the process cartridge 106 is mounted within the laser beam printer 101, it is mechanically and electrically connected to the laser beam printer 101.

A sheet supply tray 12 constituting a first sheet supply portion is removably mounted on the printer front plate 105 and a plurality of sheets $P_1$ are stacked on the tray 12. At a downstream side of the tray 12, there are disposed a sheet supply roller 15 for supplying the sheet $P_1$ and a separating pad 122 for separating the sheets $P_1$ one by one. A first sheet feeding path 125 for guiding the sheet $P_1$ is disposed between the sheet supply roller 15 and a pair of regist rollers 123 arranged at a downstream side of the sheet supply roller.

On the other hand, a sheet supply cassette 126 constituting a second sheet supply portion has an intermediate plate 127 on which sheets $P_2$ are stacked, and a pressure plate 129 for biasing a front part of the intermediate plate 127 upwardly. The pressure plate 129 tends to rotate in a clockwise direction (FIG. 1) by a spring force of a tension spring 130. The sheets $P_2$ are urged against a sheet supply roller 131, and an uppermost sheet $P_2$ is separated from the other sheets by means of a separating pawl or claw 132 and is fed to a second sheet feeding path 133 by means of the sheet supply roller 131 rotating in a direction shown by the arrow.

Between the sheet supply roller 131 and the second sheet feeding path 133, a cassette guide 135 is mounted on the sheet supply cassette 126 for up-and-down movement. The cassette guide 135 has substantially the same length (looked at from an upper side) as a width of the sheet. The cassette guide 135 is biased upwardly by a spring force of a compression spring 136 so that an upper portion 135*a* of the cassette guide extends into the body frame 102. In order to guide the sheet $P_2$ supplied from the sheet supply cassette 126 by means of the cassette guide 135 to the second sheet feeding path 133, a sheet feeding path 104 is provided. The sheet supply cassette 126 can be inserted into the body frame 102 along a direction Y and be removed from the body frame along a direction X.

The second sheet feeding path 133 is joined to the first sheet feeding path 125 at a junction 140 disposed at the downstream side of the regist rollers 123. A sheet feeding path 141 for guiding a sheet supplied from a sheet supply cassette (not shown) which can be additionally provided below the sheet supply cassette 126 is also joined to the junction 140. A sheet guide member 143 is pivotally mounted at the junction 140, so that the first sheet feeding path 125, the second sheet feeding path 133 and the additional sheet feeding path 141 can be changed over.

A transfer roller 145 is urged against the photosensitive drum 107 so that the sheet $P_1$ ($P_2$) fed from the regist rollers 123 is contacted by the photosensitive drum 107 to transfer the toner image onto the sheet $P_1$ ($P_2$). At a downstream side of the transfer roller 145, there are disposed a guide plate 147 for directing the sheet $P_1$ ($P_2$) after the transferring operation to a fixing device 146 and a sheet guide member 150 fixed to a lower portion of a frame 149 of the fixing device. The fixing device 146 comprises a fixing heat roller 146*a* and a pressure roller 146*b* for urging the sheet $P_1$ ($P_2$) against the heat roller 146*a*.

At a downstream side of the fixing device 146, there are disposed a fixing guide 152 secured to the printer front plate 105, and an ejector guide 153 provided on the body frame 102. Further, at a down streamside of the ejector guide 153, a group of ejector rollers 157 including an ejector roller 155 and a plurality of small ejector rollers 156 urged against the ejector roller 155 are arranged. The sheets $P_1$ ($P_2$) ejected by the group of ejector rollers 157 are stacked on an ejector tray 159.

In response to a printer command inputted to the laser beam printer (image forming system) 101, the sheet $P_1$ ($P_2$) is supplied from either the sheet supply tray 12 or the sheet supply cassette 126, and the supplied sheet $P_1$ ($P_2$) is fed, through the junction 140, to the paired regist rollers 123, where the skew-feed of the sheet is corrected and from where the sheet is fed to the photosensitive drum 107 at the predetermined timing. Then, the toner image is transferred from the photosensitive drum to the sheet. After the transferring operation, the sheet $P_1$ ($P_2$) is fed to the fixing device 146, where the transferred image is fixed onto the sheet. Then, the sheet is ejected onto the ejector tray 159 through the fixing guide 152, ejector guide 153 and ejector roller group 157.

Next, a sheet supply unit 27 including the sheet supply tray 12 will be fully explained with reference to FIG. 2.

An electromagnetic spring clutch 39 is mounted on the drive shaft 16 on which the sheet supply roller 15 is rotatably mounted, in the proximity of the sheet supply roller. By the operation of the electromagnetic clutch 39, the driving force from the drive shaft 16 is transmitted to the sheet supply roller 15. The drive shaft 16 is rotatably supported by bearings 35, 36, and a drive gear 37 secured to one end of the drive shaft receives the driving force from the laser beam printer 101 to be rotated in a direction shown by the arrow 29. By turning ON a switch 40*a* of an electric circuit 40 for the electromagnetic spring clutch 39, the electromagnetic clutch 39 is activated to rotate the sheet supply roller 15 connected to an output portion.

The sheet $P_1$ at rest on the sheet supply tray 12 is fed to the paired regist rollers 17 by the rotation of the sheet supply roller 15 while being guided by a sheet guide 41. When a sensor 42 positioned in the sheet feeding path sends a signal representative of the fact that it detects the passage of the sheet to a computer C shown in FIG. 1, the computer C sends a command regarding the residual energization time to the electric circuit 40, thus finishing one sheet feeding operation.

Next, the pressure engagement and disengagement between an intermediate plate 30 and the sheet supply roller 15 will be explained.

Figure 4:
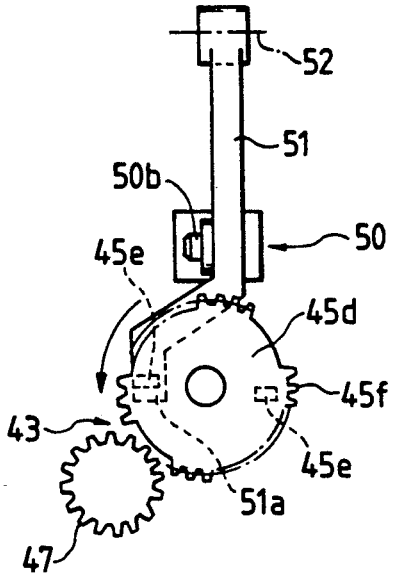
FIG. 4 is an elevational view of the clutch mechanism of FIG. 3.
Figure 5:
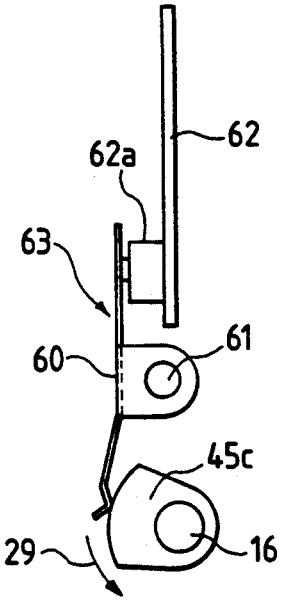
FIG. 5 is a plan view of a detection means of the sheet feeding apparatus of FIG. 2.
Figure 6:
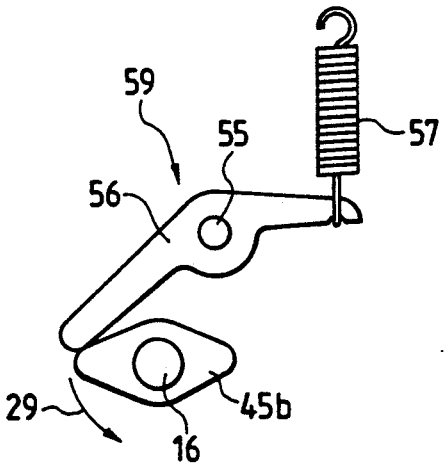
FIG. 6 is an elevational view of a bias mechanism of the sheet feeding apparatus of FIG. 2.
Figure 7:
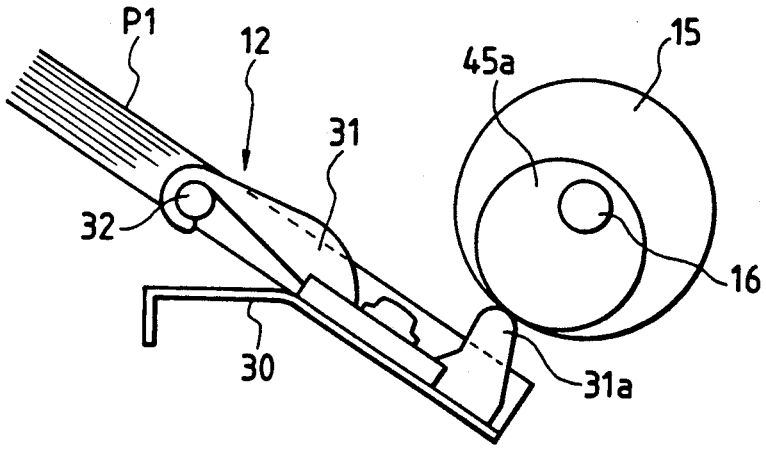
FIG. 7 is a view showing a condition that an intermediate plate is separated from a sheet supply roller in the sheet feeding apparatus of FIG. 2.

A cam set 45 is rotatably mounted on the drive shaft 16, which cam set comprises an eccentric cam 45*a* as shown in FIG. 7, an elongated biasing cam 45*b* as shown in FIG. 6, a cam 45*c* for a detection switch, as shown in FIG. 5, and a notched gear 45*d* (gear having no gear portion) as shown in FIG. 4, these elements 45*a*–45*d* being formed integrally. A gear 46 secured to the drive shaft 16 is meshed with an elongated common gear 47 which in turn can be meshed with a gear portion 45*f* of the notched gear 45*d*.

Figure 3:
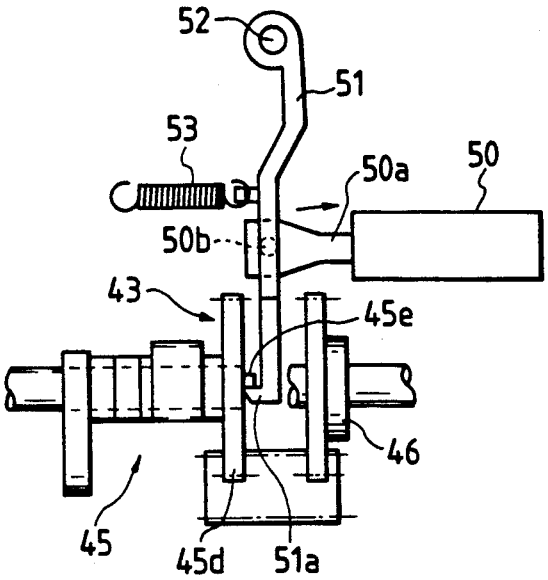
FIG. 3 is a plan view of a clutch mechanism of the sheet feeding apparatus of FIG. 2.

A pair of stoppers 45*e* is arranged at one side of the notched gear 45*d*, and, as shown in FIG. 3, a pawl 51*a* formed on a free end of a clutch arm 51 is engaged by the stopper 45*e*. The clutch arm 51 supported at its base portion by a support shaft 52 is biased by a spring force of a tension spring 53 so that the pawl 51*a* is urged against the notched gear 45*d*. Further, a plunger 50*a* of a DC solenoid 50 is pivotally mounted on the clutch arm 51 via a pin 50*b*.

A support arm 31 is attached to one side of the intermediate plate 30, and a protruded portion 31*a* formed on a free end of the support arm is biased to pressure contact with the eccentric cam 45*a* by a spring force of a tension spring 33 attached to the intermediate plate 30. Further, as shown in FIG. 6, one end of an arm 56 pivotally mounted on a support shaft 55 is urged against the biasing cam 45*b*, which arm 56 serves to bias the biasing cam 45*b* to rotate the latter in a direction shown by the arrow, via tension spring 57. The biasing cam 45*b*, arm 56 and tension spring 57 constitute a biasing mechanism. Further, the notched gear 45*d* shown in FIG. 3, clutch arm 51 and DC solenoid 50 constitute a clutch mechanism 43.

Figure 2:
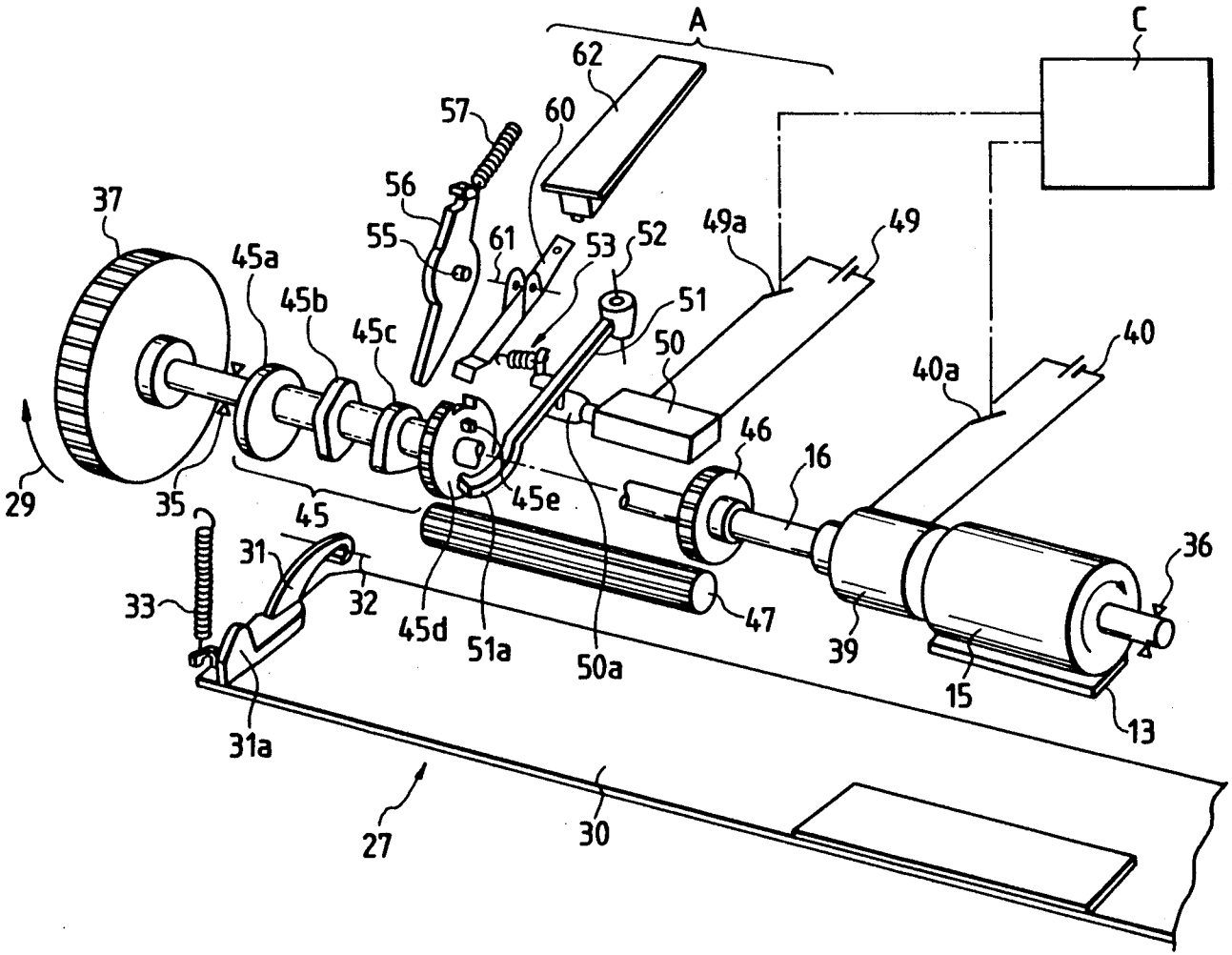
FIG. 2 is a perspective view of a sheet feeding apparatus according to a preferred embodiment of the present invention.

When the switch 49*a* of the electric circuit 49 shown in FIG. 2 is closed by the command from the computer (controlling portion) C shown in FIG. 1, the DC solenoid 50 is activated to disengage the pawl 51*a* of the clutch arm 51 from the stopper 45*e* of the notched gear 45*d*. Consequently, the arm shown in FIG. 6 rotates the biasing cam 45*b* in the direction shown by the arrow by the spring force of the tension spring 57. At the same time, the notched gear 45*d* shown in FIG. 4 is rotated in the direction shown by the arrow so that the toothed portion 45*f* is meshed with the common gear 47, with the result that the cam set 45 is rotated in the direction shown by the arrow by a half revolution.

In this case, the electric circuit 49 is being disenergized so that the clutch arm 51 is abutted against the notched gear 45*d* by the spring force of the tension spring 53. Since the two stoppers 45*e* are diametrically opposed to each other on the notched gear 45*d*, when the cam set 45 is rotated by a half revolution, the stopper 45*e* is engaged by the pawl 51*a* of the clutch arm 51 again, thus stopping the rotation of the cam set 45. Incidentally, as shown in FIG. 4, when the common gear 47 is positioned at the no gear portion of the notched gear 45*d*, the cam set 45 is always subjected to the force tending to rotate the cam set in the direction shown by the arrow, by the action of the biasing mechanism 59 shown in FIG. 6.

Figure 8:
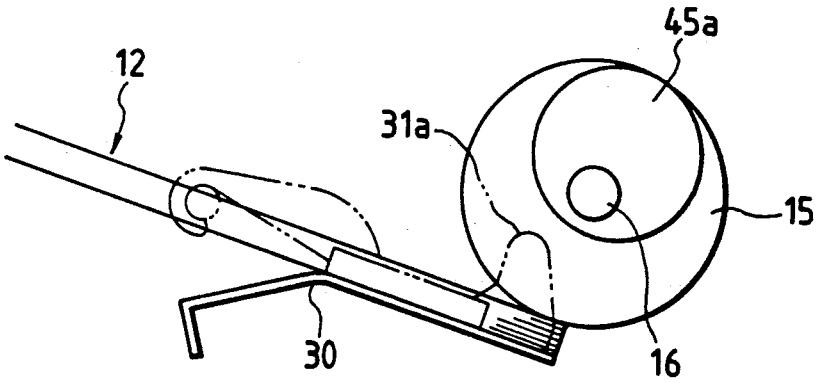
FIG. 8 is a view showing a condition that the intermediate plate is urged against the sheet supply roller in the sheet feeding apparatus of FIG. 2.

By the half revolution of the cam set 45, the intermediate plate 30 changes from a condition shown in FIG. 7 to a condition shown in FIG. 8, in response to the rotation of the eccentric cam 45*a*. That is to say, by rotating the eccentric cam 45*a* by a half revolution from the position shown in FIG. 7, the intermediate plate 30 is rotated to lift the free end thereof by the spring force of the tension spring 33, so that the sheets $P_1$ stacked on the tray 12 is urged against the sheet supply roller 15 to permit the feeding-out of the sheet. In this condition, when the sheet supply roller 15 is rotated, the sheets $P_1$ are continuously supplied. Thus, it is not needed to lift and lower the intermediate plate whenever each sheet $P_1$ is supplied.

By repeating the above operation to further rotate the cam set 45 by a half revolution, the relation between the intermediate plate 30 and the sheet supply roller 15 is changed from the condition shown in FIG. 8 to the condition shown in FIG. 7 wherein the sheets $P_1$ are separated from the sheet supply roller 15, thereby facilitating replenishing new sheets on the intermediate plate 30.

A detection mechanism 63 shown in FIG. 5 is provided for detecting the present relation between the intermediate plate 30 and the sheet supply roller 15 and for inputing a signal representative of such relation to the computer C during the above-mentioned engagement and disengagement of the intermediate plate 30 with respect to the sheet supply roller 15. The detection mechanism 63 comprises the cam 45*c* of the cam set 45, a switch arm 60 urged against the cam 45*c* and rotatable around a support shaft 61, and a switch substrate 62 having a switch 62*a* turned ON/OFF by the switch arm 60.

With this arrangement, the engagement and disengagement of the intermediate plate 30 and accordingly the sheets $P_1$ regarding the sheet supply roller 15, and the supplying of the sheet $P_1$ by means of the sheet supply roller 15 are effected sequentially as a series of operations. Incidentally, in the illustrated embodiment, while the clutch mechanism for performing the engagement and disengagement of the intermediate plate 30 was constituted by the notched gear 45*d*, such mechanism may be constituted by the clutch mechanism as shown in FIG. 1.

Further, a sheet containing portion (means) driving means A is constituted by the aforementioned clutch mechanism including the cam set 45 and the biasing mechanism 59. The sheet containing portion driving means A is attached to the sheet feeding apparatus as a separate unit which causes the sheet supply unit 27 to perform a series of sheet supplying operations.

According to the above-mentioned arrangement, by providing the sheet supply means including the sheet supply roller 15 and the electromagnetic spring clutch 39 and the sheet containing portion driving means for controlling the engagement and disengagement of the intermediate plate 30 of the sheet supply tray 12, on the drive shaft 16 always being rotated by the driving force from the printer, the following advantages can be obtained.

(1) It is possible to voluntarily set the exchange and reprenishment of the sheets Pl at a software site, so that it is not needed to control the movement of the intermediate plate whenever each sheet $P_1$ is supplied, thereby improving the endurance of the sheet feeding apparatus and reducing the occurrence of the impact noise during urging the intermediate plate against the sheet supply means.

(2) In the sheet supplying operation, it is possible to freely set the number of revolutions of the sheet supply roller 15 in correspondence to the sheet path length and to increase or decrease the outer diameter of the sheet supply roller 15 without any limitation. Further, since the sheet supply roller 15 is directly driven by the electromagnetic clutch 39, it is possible to reduce the back tension during the sheet supplying operation.

Next, the cassette guide 135 used for guiding the sheet $P_2$ supplied from the sheet supply cassette 126 will be described.

Figure 9:
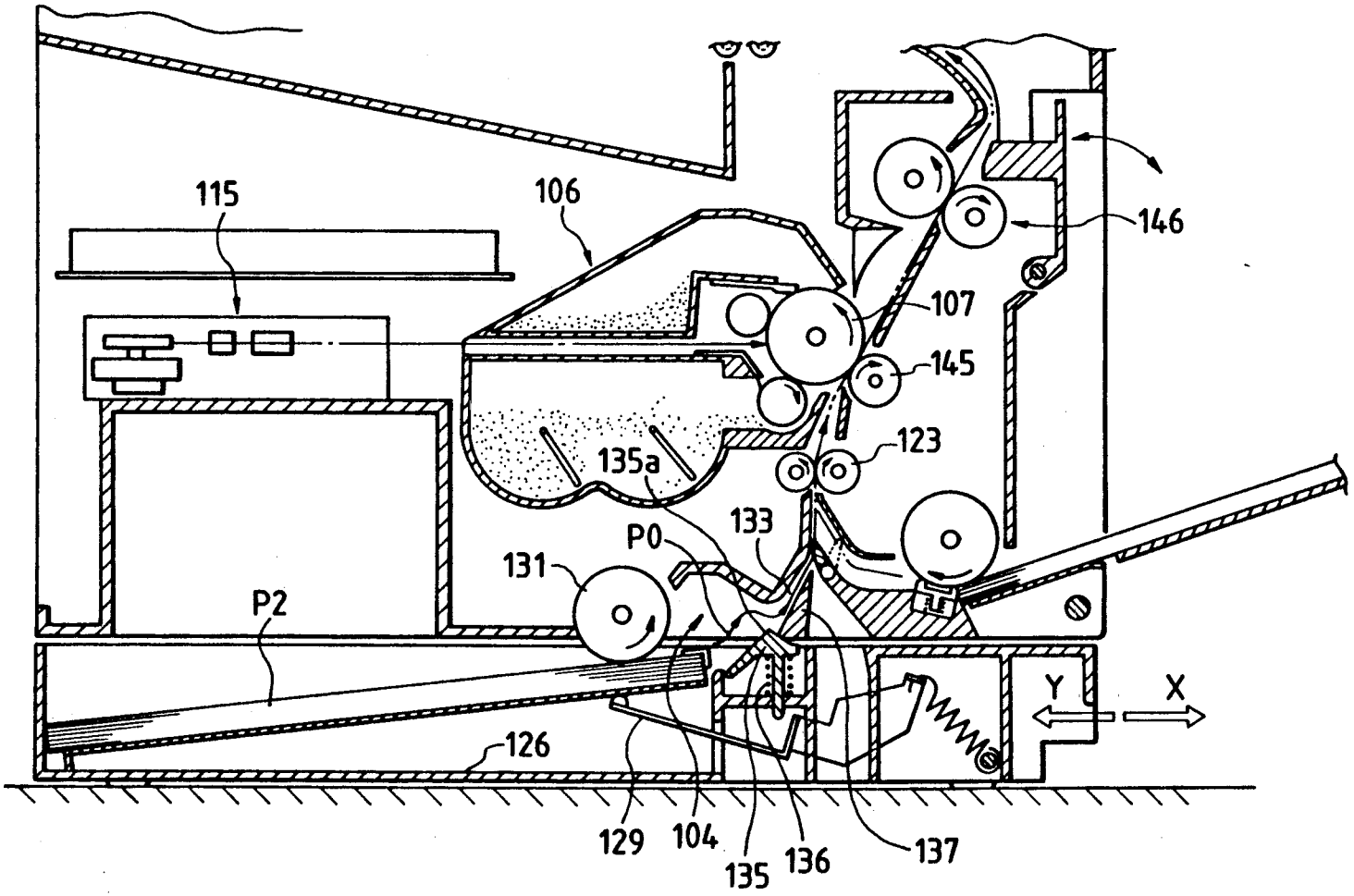
FIG. 9 is an elevational sectional view showing a condition that a sheet is supplied from a cassette in the printer of FIG. 1.

During the sheet $P_2$ supplying operation effected by the sheet supply roller 131, the sheet $P_2$ fed out from the sheet supply cassette 126 is directed to the cassette guide 135 included in the sheet supply cassette 126 and then is directed to the sheet feeding path 133 formed by a pre-registration guide 137. An upper portion 135*a* of the cassette guide 135 is positioned higher than a lower end of the preregistration guide 137, so that, when the sheet $P_2$ passes through the sheet feeding path 104, a loop $P_0$ is formed in a leading end portion of the sheet $P_2$ as shown in FIG. 9. The looped leading end portion of the sheet $P_2$ can uniformly advance along the transfer roller 145 due to the repelling force of the sheet itself.

Figure 10:
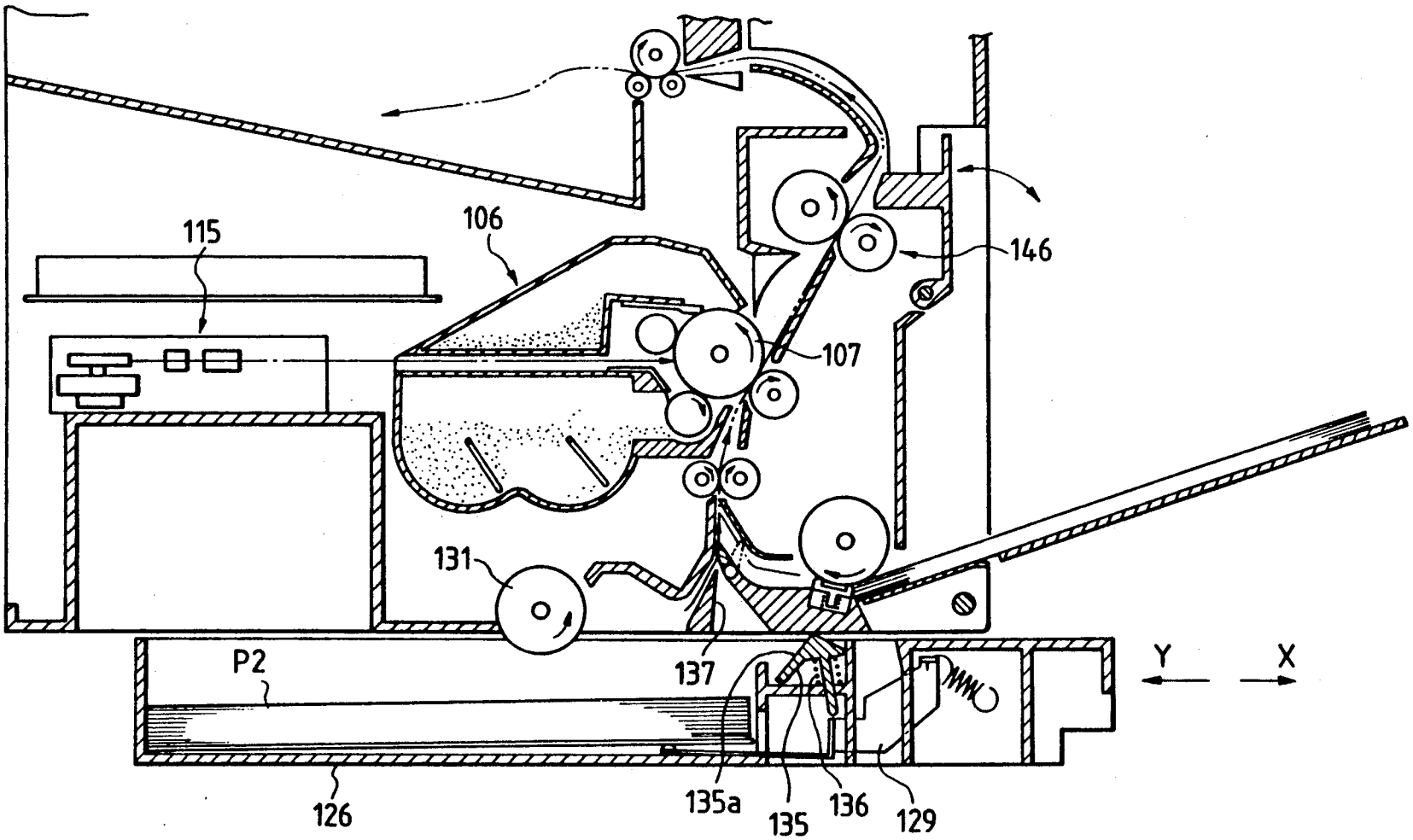
FIG. 10 is an elevational sectional view showing the mounting and dismounting of the cassette.

FIG. 10 shows a condition of the cassette guide 135 when the sheet supply cassette 126 is being removed along the direction X.

As already described with reference to FIG. 9, although the upper portion of the cassette guide 135 is positioned higher than the lower end of the pre-registration guide 137, when the sheet supply cassette 126 is shifted in the direction X, the upper portion 135*a* of the cassette guide 135 is pushed down by a lower surface of the body frame 102 to be retracted. Consequently, the cassette guide 135 can pass through the pre-registration guide 137 and the bottom of the body frame 102, thereby avoiding the interference between the cassette guide 135 and the body frame 102 during the shifting movement of the sheet supply cassette 126 toward the direction X. Similarly, when the sheet supply cassette 126 is inserted along the direction Y, since the cassette guide 135 can be pushed downwardly, the interference between the cassette guide and the body frame and/or pre-registration guide can be avoided.

Figure 11:
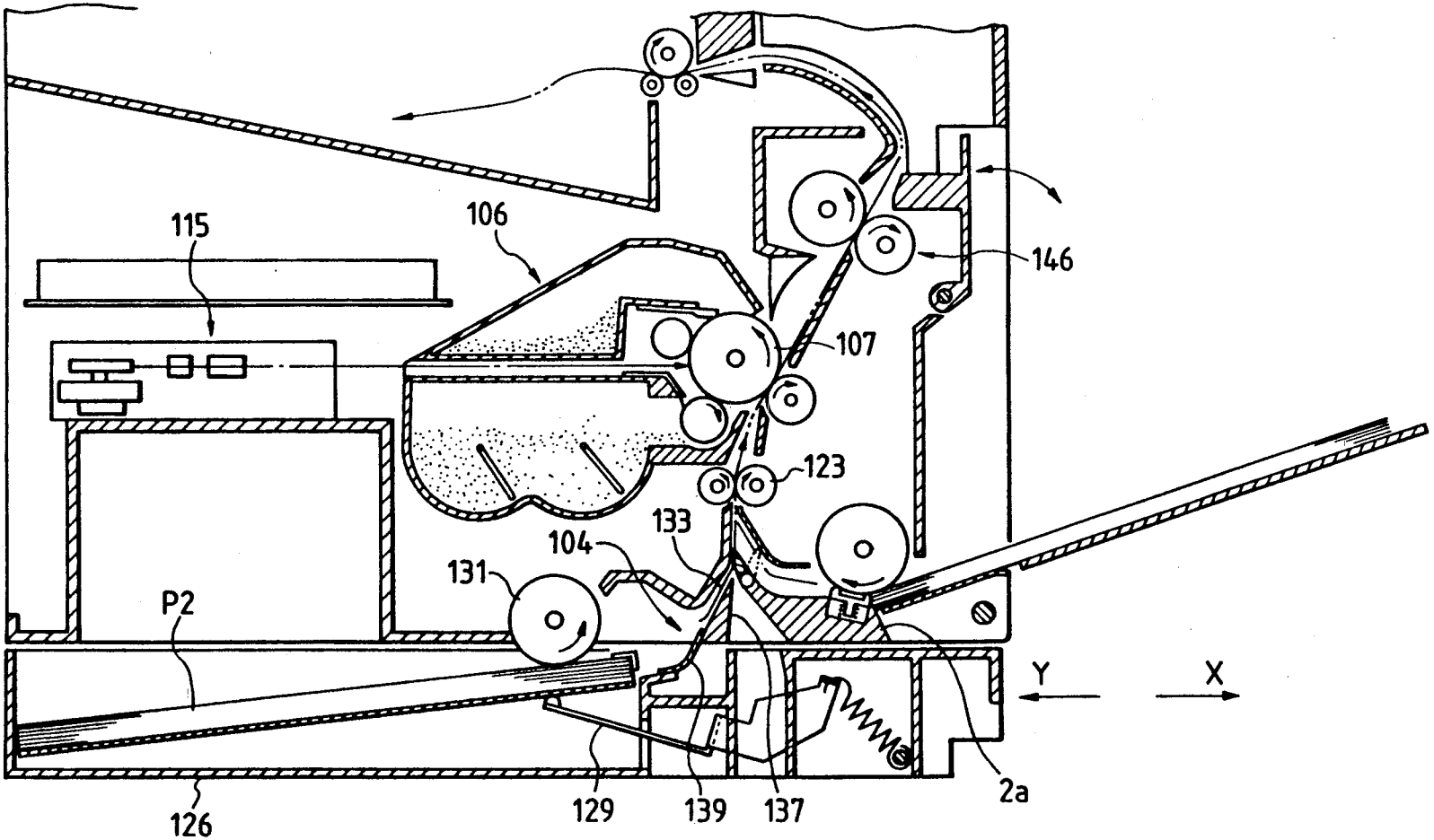
FIG. 11 is an elevational view showing another embodiment of the cassette.

FIG. 11 shows another embodiment of the cassette guide.

In this embodiment, the sheet supply cassette 126 is provided with an elastic member 139, in place of the aforementioned cassette guide 135. An upper portion of the elastic member 139 extends into the body frame 102 to form the sheet feeding path 104. The sheet $P_2$ fed by the sheet supply roller 131 is directed to the sheet feeding path 133 by means of the elastic member 139 and then is fed to the regist rollers 123. Further, when the sheet supply cassette 126 is inserted into or removed from the body frame 102, since the elastic member 139 can be retracted below the bottoms of the pre-registration guide 137 and of the body frame 102 by its own elasticity, the interference between the elastic member and the pre-registration guide and/or the body frame can be avoided, whereby the removal and insertion of the sheet supply cassette 126 can be performed smoothly.

Further, in the above-mentioned embodiments, while an example that the body frame 102 is positioned above the sheet supply cassette 126 was explained, if a further or additional sheet supply cassette is arranged above the sheet supply cassette 126 (dual cassette arrangement), the cassette guide 135 or 139 can be similarly functioned.

With the above-mentioned arrangement, since the height of the introduction opening for the sheet supply cassette 126 at the laser beam printer or at the sheet supplying portion can be smaller, the whole height of the image forming system such as the laser beam printer, copying machine and the like can be reduced.

Next, a sheet guide member 143 disposed at the junction 140 will be explained. As shown in FIGS. 12 and 13, the sheet guide member 143 is pivotally supported at its base by the body frame 102 via a support shaft 142, so that a free end of the sheet guide member is directed substantially uprightly.

Figure 12A:
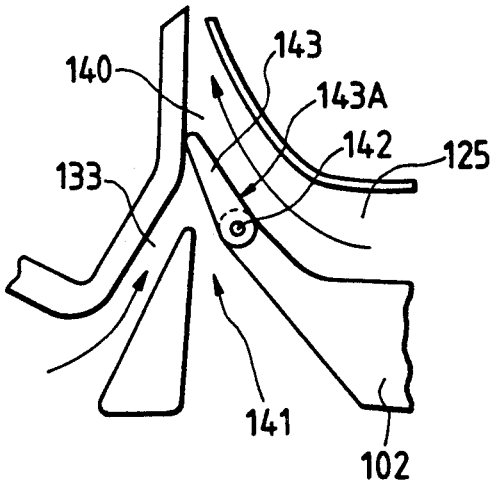
FIGS. 12A, 12B and 13A, 13B are partial sectional view showing an operation of a guide disposed at a junction between feeding paths in the printer of FIG. 1.
Figure 12B:
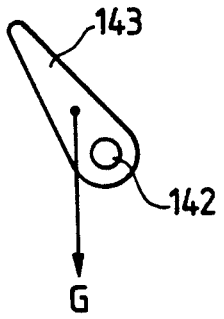

Now, when the sheet $P_2$ is fed from the sheet supply cassette 126 in a condition that the sheet guide member 143 blocks the second sheet feeding path 133 as shown in FIGS. 12A and 12B, the sheet guide member 143 is retarded or pivoted toward an inoperative or retarded position 143B (toward the first sheet feeding path 125) by the leading end of the firstly fed sheet $P_2$, thereby opening the second sheet feeding path 133. The sheet $P_2$ can be fed to the paired regist rollers 123 without slidingly contacting with the sheet guide member 143, thus preventing the noise and the charging phenomenon due to the sliding contact between the sheet and the sheet guide member. Further, the sheet (not shown) supplied from the additional sheet supply cassette (not shown) can also be conveyed in the similar manner to the sheet $P_2$.

On the other hand, when the sheet guide member 143 assumes a position shown in FIG. 13, as the sheet $P_1$ is supplied from the sheet supply tray 12, the sheet guide member 143 is retarded or pivoted toward an inoperative or retarded position 143A (toward the second sheet feeding path 133) by the leading end of the firstly fed sheet $P_1$, thereby opening the first sheet feeding path 125. Thus, the sheet $P_1$ can be stably fed to the paired regist rollers 123 without slidingly contacting with the sheet guide member 143.

Figure 13A:
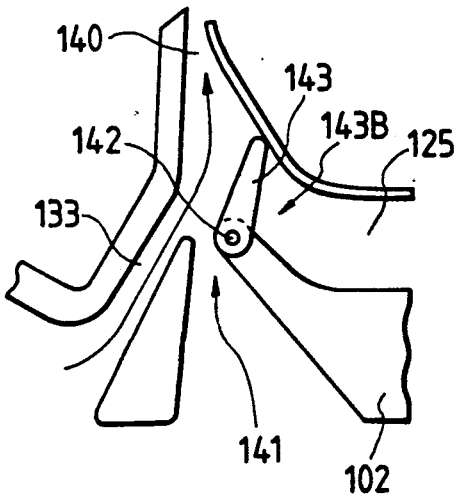
Figure 13B:
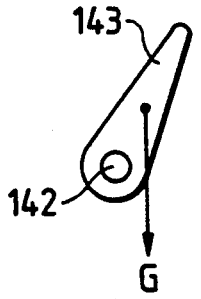

When the sheet guide member 143 is retarded to the retarded position 143B as shown in FIG. 13A by the action of the sheet $P_2$ fed from the second sheet feeding path 133, as shown in FIG. 13B, the sheet guide member 143 is biased to rotate in a clockwise direction by its own weight, whereby the sheet guide member 143 is held in the retarded position 143B by its own weight. Similarly, when the sheet guide member 143 is pivoted to the retarded position 143A as shown in FIG. 12A by the action of the sheet $P_1$ fed from the first sheet feeding path 125, as shown in FIG. 12B, since the sheet guide member 143 is biased to rotate in an anti-clockwise direction by its own weight, the sheet guide member 143 is held in the retarded position 143A by its own weight.

As shown in the illustrated embodiment, sinde the sheet feeding paths 125, 133 change their postures from a substantially horizontal condition to a vertical condition at an area where the first sheet feeding path 125 joins to the second sheet feeding path 133, these first and second sheet feeding paths 125, 133 are joined together at their curved portions. In this case, if a thicker sheet such as a thicker paper, post card, envelope and the like is fed, the greater the radius of curvature of each sheet feeding path the less the formation of shrinkage in the sheet and/or poor feeding of the sheet are apt to be occurred.

However, for example, if a fixed junction (i.e., having no changing-over means) for the sheet feeding paths is used, the radius of curvature of each sheet feeding path will be limited. To the contrary, as in the illustrated embodiment, when the sheet guide member 143 is provided at the junction 140 for blocking one of the sheet feeding paths which is not used for guiding the sheet, the radius of curvature of the sheet feeding path which is now used for guiding the sheet can be increased at the maximum, whereby it is possible to feed the sheet more stably. In this way, by providing the sheet guide member at the junction between the sheet feeding paths having the opposed curvatures, the more stable sheet feeding operation can be obtained.

In an embodiment shown in FIG. 14, a sheet feeding path disposed at a downstream side of the junction 140 extends substantially in a horizontal direction. A tension spring 161 is arranged between the sheet guide member 143 disposed at the junction 140 and a pin 160 formed on the body frame 102. The support shaft 142 is positioned substantially at an intermediate point of the tension spring 161. The tension spring 161, sheet guide member 143 and support shaft 142 constitute a toggle mechansim.

Figure 14A:
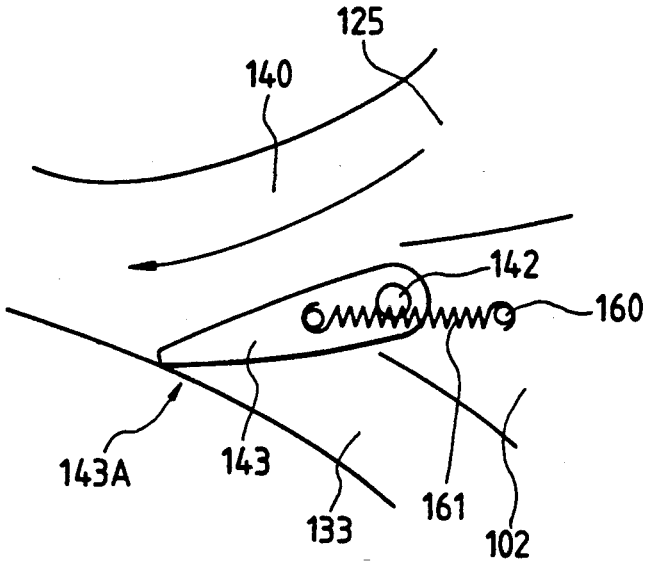
FIGS. 14A and 14B are views showing an operation of a guide according to another embodiment disposed at the junction between the feeding paths.
Figure 14B:
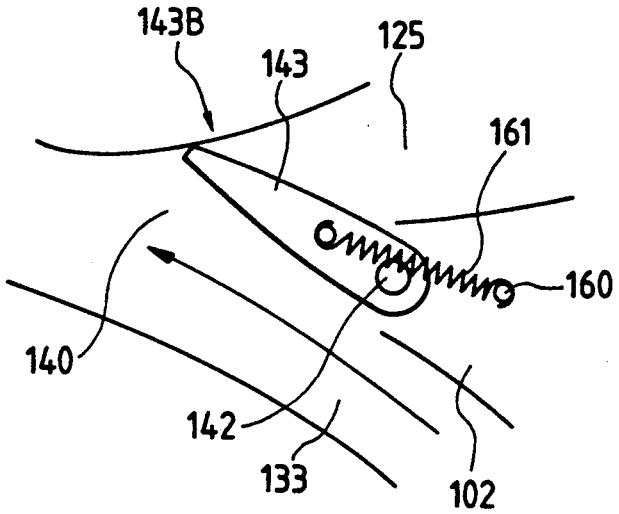

When the sheet guide member 143 assumes a position shown in FIG. 14A, as the sheet $P_2$ is fed from the second sheet feeding path 133, as shown in FIG. 14B, the sheet guide member 143 is rotated to retard toward the retarded position 143B (toward the first sheet feeding path 125) and is held in the retarded position by means of the toggle mechanism. Similarly, when the sheet guide member 143 assumes a position shown in FIG. 14B, as the sheet $P_1$ is fed from the first sheet feeding path 125, as shown in FIG. 14A, the sheet guide member 143 is rotated from the position shown in FIG. 14B to the retarded position 143A shown in FIG. 14A and is held in the retarded position 143A by means of the toggle mechanism.

FIG. 15 shows another embodiment of the sheet guide member disposed at the junction.

Figure 15A:
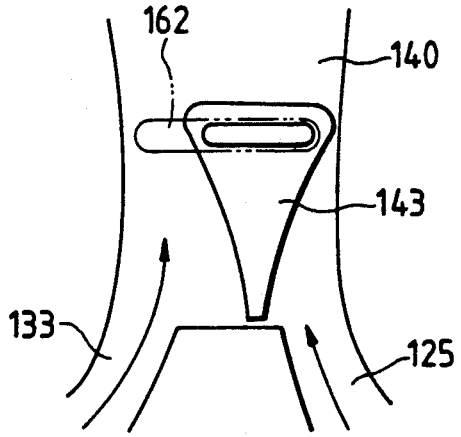
FIGS. 15A and 15B are views showing an operation of a guide according to a further embodiment disposed at the junction between the feeding paths.
Figure 15B:
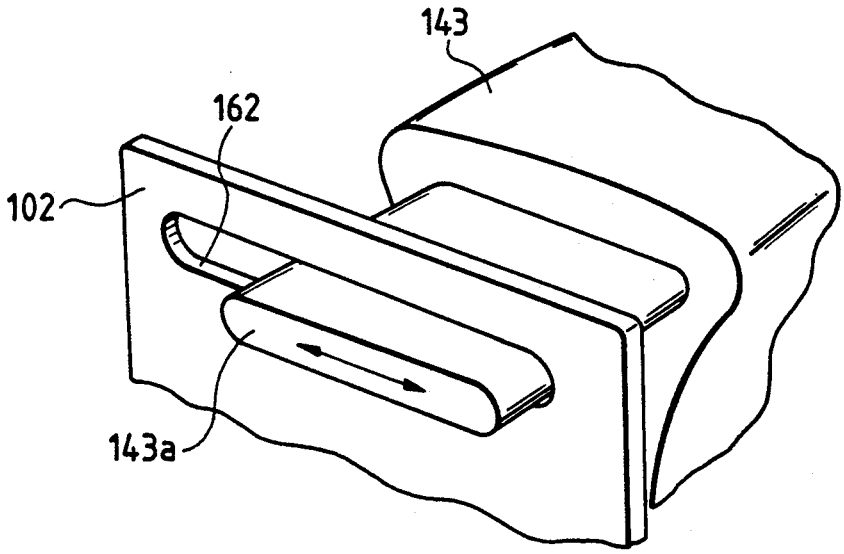

In this embodiment (FIGS. 15A and 15B), the sheet guide member 143 is not pivoted as in the previous embodiment, but is translated substantially in a horizontal direction. In FIG. 15A, an elongated slots 162 formed in the body frame 102 are disposed at the junction 140 between the first sheet feeding path 125 and the second sheet feeding path 133. As shown in FIG. 15B, a sliding projections 143*a* formed on both side portions of the sheet guide member 143 are slidingly engaged by the elongated slots 162. Further, in the illustrated embodiment, the sheet guide member 143 has a downwardly tapered configuration, so that, when the inclined surface of the sheet guide member 143 is pushed by the leading end of the supplied sheet $P_1$ ($P_2$), the sheet guide member 143 is shifted to the retarded position (inoperative side), thereby opening the sheet feeding path 133 (125) which is to be utilized. The sheet guide member 143 according to this embodiment is also held in the retarded position by its own weight.

As mentioned above, since the sheet guide member for changing-over the sheet feeding paths is arranged at the junction between a plurality of sheet feeding paths so that the sheet guide member can be selectively shifted to the retarded position where it closes the inoperative or non-used sheet feeding path, the sheets being fed do not slidingly contact with the sheet guide member, whereby the charging of the sheet and the distortion of the image (due to the charging of the sheet) formed on the sheet and/or resistance of the sheet guide member to the sheet and the reduction in the sheet feeding speed (due to such resistance) can be prevented, and further, the noise generated by the sliding contact between the sheet and the sheet guide member can also be eliminated.

Further, since the sheet guide member is shifted to the retarded position and is held there by the fed sheet, there is no need to provide special driving means for shifting the sheet guide member to the retarded position and special holding means for holding the sheet guide member in the retarded position, thereby providing a stable sheet feeding apparatus which is simple, inexpensive and reliable.

Next, a jam treatment mechansim provided at the sheet ejecting portion will be explained.

Figure 16:
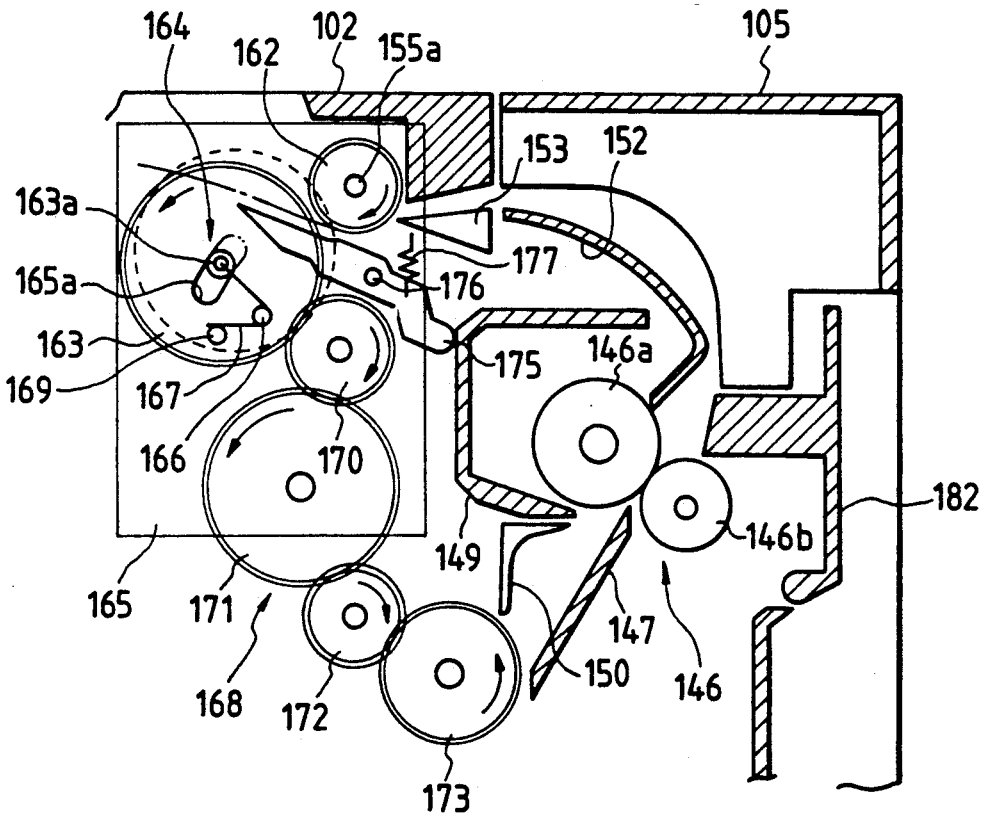
FIG. 16 is an elevational sectional view of a drive connecting mechanism for ejector rollers in the printer of FIG. 1.

In FIG. 1, the small ejector rollers 156 in the ejector roller group 157 are pivotally supported by a support member 160 and are urged against the ejector roller 155 by means of a pressurizing spring 161. Further, a drum gear 173 integrally formed with the photosensitive drum 107 is meshed with a drive gear 172 connected to a drive source (not shown), as shown in FIG. 16.

As idle gear 171 meshed with the drive gear 172 and an idle gear 170 meshed with the idle gear 171 are pivotally supported by a support plate 165, respectively. Further, a connection gear 163 meshed with the idle gear 170 can be rocked around a rotation axis of the idle gear 170 between a position shown by the solid line in FIG. 16 and a position shown by the broken line. To this end, a bearing 163*a* for the connection gear 163 can be guided in a slot 165*a* formed in the support plate 165. In addition, both ends of a torsion spring 167 attached to a support shaft 166 are engaged by a pin 169 and the bearing 163*a*, respectively, so that the connection gear 163 is urged against an ejector roller gear 162. The bearing 163*a*, slot 165*a*, torsion spring 167 and the like constitute a rocking mechanism 164 for rocking the connection gear 163. Further, a gear train positioned from the drive gear 172 to the connection gear 163 constitutes a drive connecting mechanism 168 for transmitting a driving force of the drive gear 172 to the ejector roller gear 162.

A release lever 175 is pivotally mounted on the support plate 165 via a support shaft 176, which release lever 175 is biased in an anti-clockwise direction (FIG. 16) by a pressurizing spring 177. An outer end portion (right end portion in FIG. 16) of the release lever 175 assumes a condition shown in FIG. 16 wherein the release lever has been rotated in a clockwise direction by a fixing frame 149 when the printer front plate 105 is closed as shown in FIG. 16. In this condition, the connection gear 163 assumes the broken line position where it is meshed with the ejector roller gear 162 so that the driving force of the drive gear 172 is transmitted to the ejector roller gear.

Figure 17:
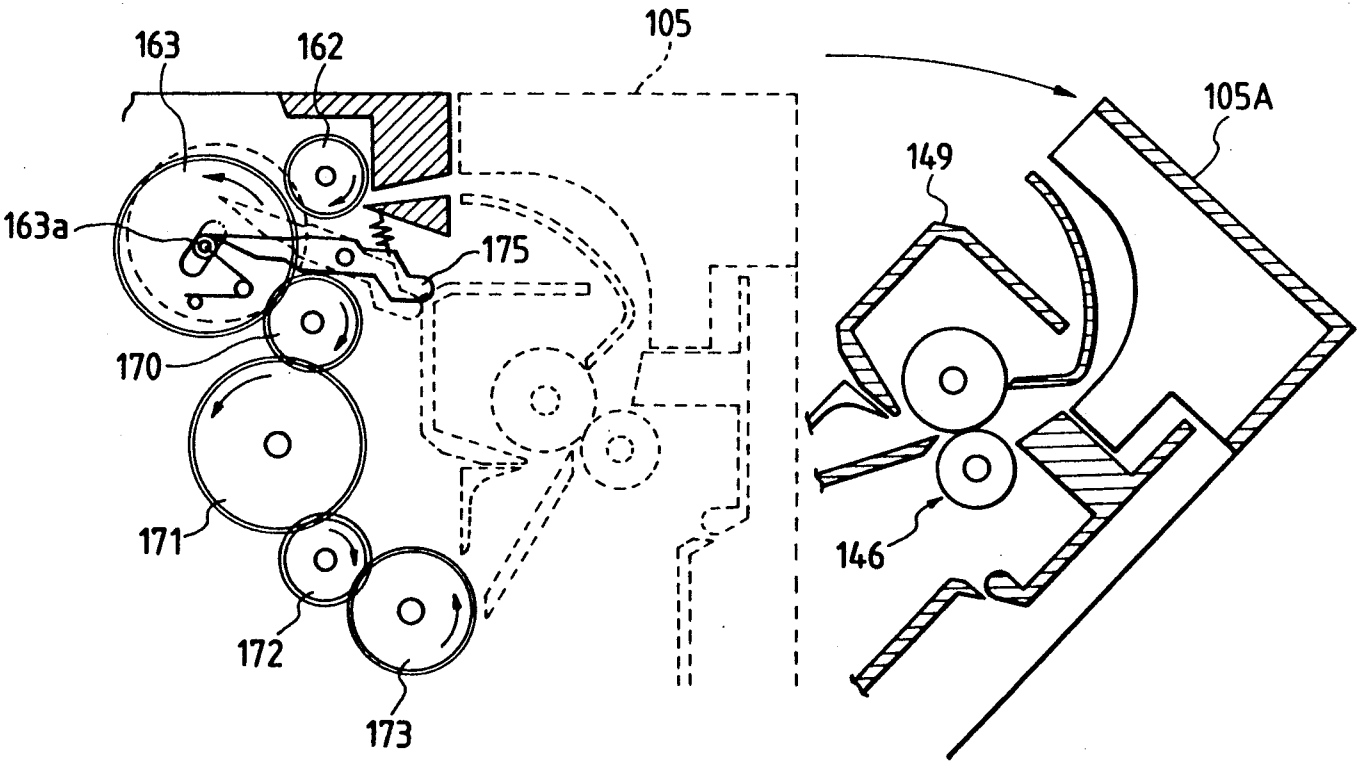
FIG. 17 is a view showing an operation of the mechanism of FIG. 16.

Now, if the sheet is jammed in the fixing device 146, by opening a cover 182, the jammed sheet can be removed. If the sheet is jammed in the ejector roller group 157, the printer front plate 105 is opened as shown in FIG. 17. By opening the printer front plate 105, the release lever 175 is rotated from a broken line position (FIG. 17) to a solid line position by the pressurizing spring 177.

By the above rotation of the release lever 175, an inner end (left end in FIG. 17) of the release lever 175 urgingly rotates the bearing 163*a* to rock the connection gear 163 from the broken line position to the solid line position, thus releasing the driving connection between the connection gear 163, and the ejector roller gear 162 and the ejector roller 155 integral with the ejector roller gear. In this condition, since the ejector roller group 157 is disconnected from the drive gear 172, the ejector roller group can easily be rotated manually, thus easily removing the jammed sheet.

Further, when the printer front plate 105 is closed as shown in FIG. 16 after the jam treatment operation has been finished, since the release lever 175 is rotated in the clockwise direction by the fixing frame 149, the connection gear 163 is engaged by the ejector roller gear 162 again by means of the torsion spring 163, with the result that the driving force of the drive gear 172 can be transmitted to the ejector roller group 157.

In addition, in a condition that the printer front plate 105 is closed, when the sheet remaining in the ejector roller group 157 is pulled toward the ejecting direction, the ejector roller gear 162 is rotated in a direction shown by the arrow (clockwise direction). In response to this rotation of the ejector roller gear, the connection gear 163 tries to rotate in a direction shown by the arrow (anti-clockwise direction). However, since the idle gear 170 meshed with the connection gear 172 is not rotated, the connection gear 163 rolles on the idle gear 170, thereby releasing the connection between the connection gear 163 and the ejector roller gear 162.

Figure 18:
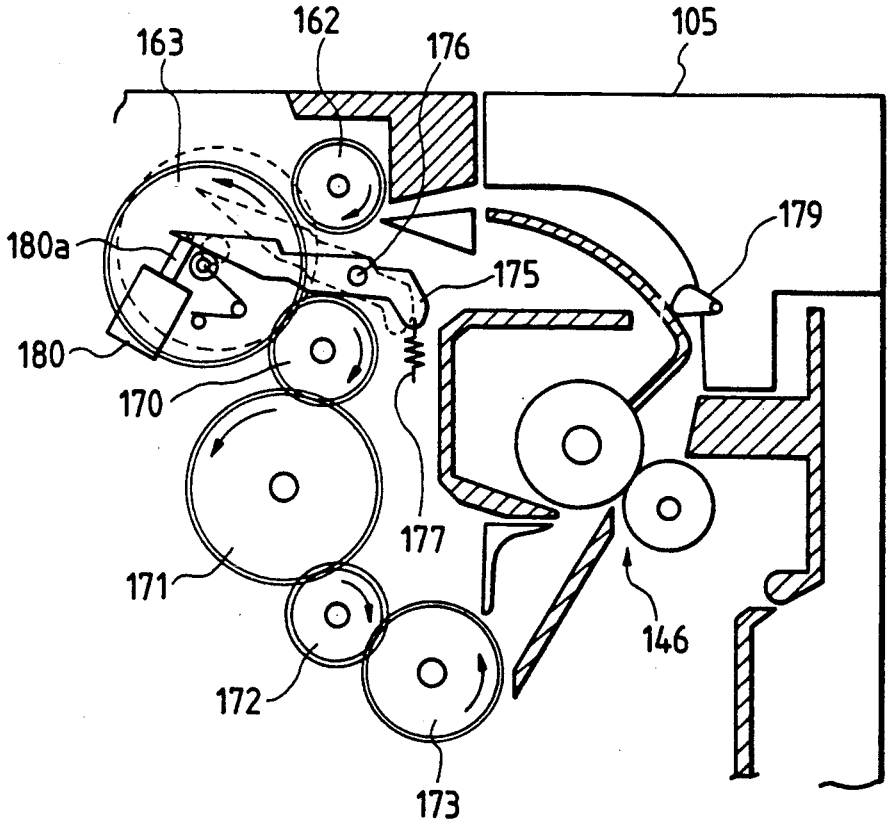
FIG. 18 is an elevational view of a drive connecting mechanism for ejector rollers according to another embodiment.

FIG. 18 shows a drive connecting mechanism according to another embodiment.

In this embodiment, the release lever 175 is biased in a clockwise direction in FIG. 18 by means of the pressurizing spring 177. Further, a plunger 180*a* of a solenoid 180 is connected to an inner end of the release lever 175. When the jamming of the sheet is detected in the ejector roller group 157, the solenoid 180 is activated so that the release lever 175 is rotated from the broken line position to the solid line position. Such rotation of the release lever 175 causes the disconnection between the release lever and the ejector roller gear 162, with the result that the jammed sheet can easily be removed.

As mentioned above, since the drive system for driving the ejector roller group is arranged at the body frame side, even when the printer front plate is opened and closed during the jam treatment operation, the gears do not strike against each other. Consequently, the collision of the gears and the damage of the gears can be prevented during the opening and closing of the printer front plate, and the driving system can be simplified, thus making the apparatus inexpensive. Further, since the rocking movement of the connection gear for performing the connection and disconnection of the driving system is obtained by the bearing 163*a* and the slot 165*a* for guiding the bearing, any arms for rocking the connection gear are not required, thus making the apparatus inexpensive.

Next, a guide arranged between the transferring portion and the fixing device 146 will be explained.

Figure 19:
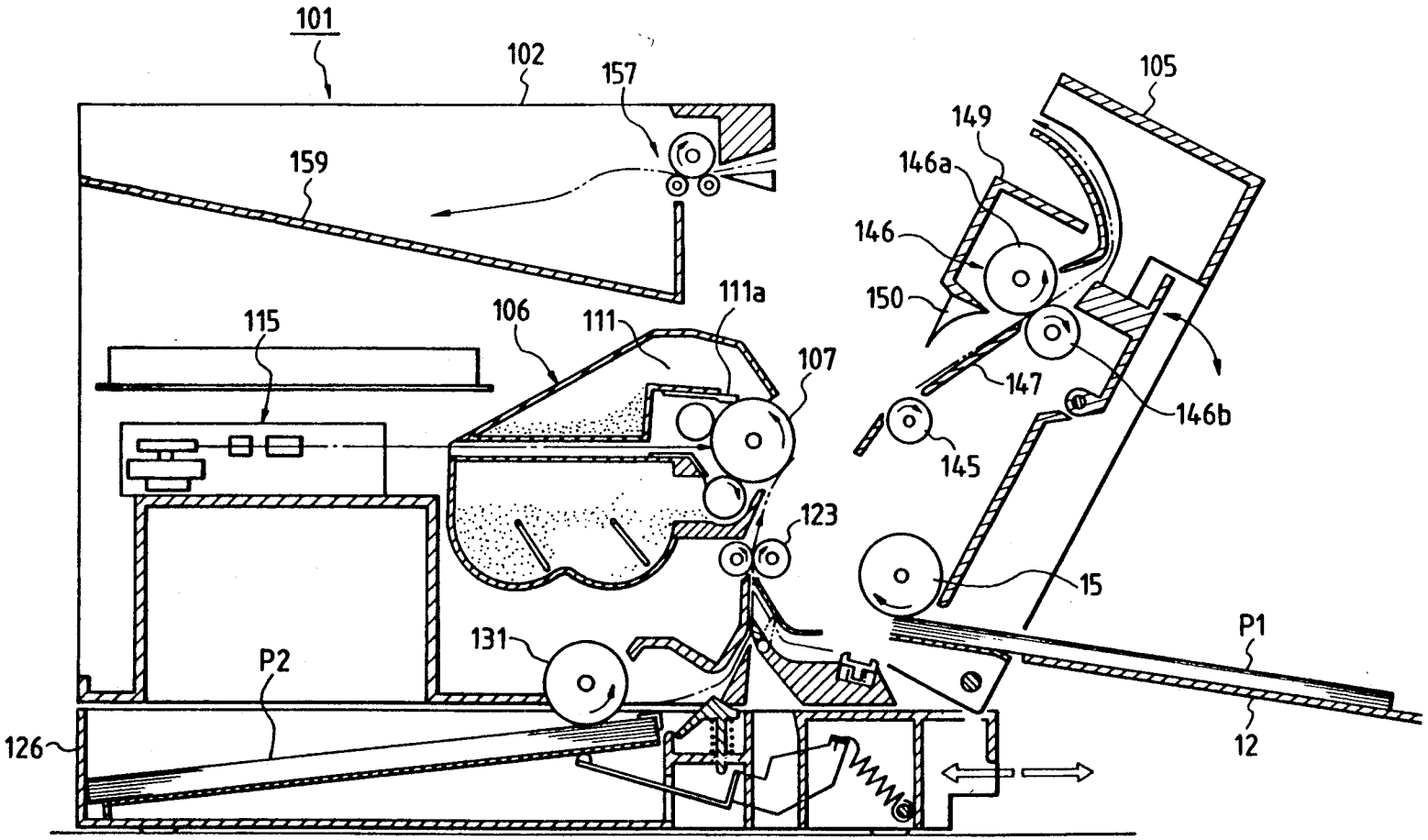
FIG. 19 is an elevational sectional view showing a condition that a front plate of the printer of FIG. 1 is released.

In FIG. 19, the sheet supply tray 12, sheet supply roller 15, transfer roller 145, guide plate 147 and fixing device 146 are mounted on the printer front plate 105, so that, if the fed sheet $P_1$ ($P_2$) is jammed, the jammed sheet can be removed after the printer front plate 105 is opened as shown in FIG. 19.

In response to the printer command inputed to the laser beam printer 101, the sheet $P_1$ ($P_2$) is supplied from either the sheet supply tray 12 or the sheet supply cassette 126, and the supplied sheet $P_1$ ($P_2$) is fed, through the junction 140, to the paired regist rollers 123, where the skew-feed of the sheet is corrected and from where the sheet is fed to the photosensitive drum 107 at the predetermined timing.

While the sheet $P_1$ ($P_2$) is being moved between the photosensitive drum 107 and the transfer roller 145, by a voltage (having a polarity opposite to that of the toner) applied to the transfer roller 145 and an urging force between the photosensitive drum 107 and the transfer roller 145, the toner images formed on the photosensitive drum 107 are sequentially transferred on the sheets $P_1$ ($P_2$). The application of the voltage to the transfer roller 145 is effected when the leading end of the sheet $P_1$ ($P_2$) reaches the contact area (transfer portion) between the photosensitive drum 107 and the transfer roller 145.

After the sheet $P_1$ ($P_2$) has passed through the transfer portion, it is separated from the photosensitive drum 107 and then is guided by a guide plate 147 or a sheet guide member 150 to reach the fixing device 146. After the toner image is fixed onto the sheet $P_1$ ($P_2$) in the fixing device 146, the sheet is ejected onto the ejector tray 159 by means of the ejector roller group 157.

After the transferring operation, the residual toner and other contaminations remaining on the photosensitive drum 107 are removed by the cleaner 111 so that the drum can be used repeatedly to form the latent image thereon.

As mentioned above, in the illustrated embodiment, since the sheet guide member 150 is disposed at a side of the surface of the sheet $P_1$ ($P_2$) on which the toner image is transferred, after the transferring operation, the sheet $P_1$ ($P_2$) is prevented from entering into the cleaning blade 111*a* of the cleaner 111, with the result that the jamming of the sheet can be avoided and the sheet $P_1$ ($P_2$) can be surely fed to the fixing device 146.

Figure 20:
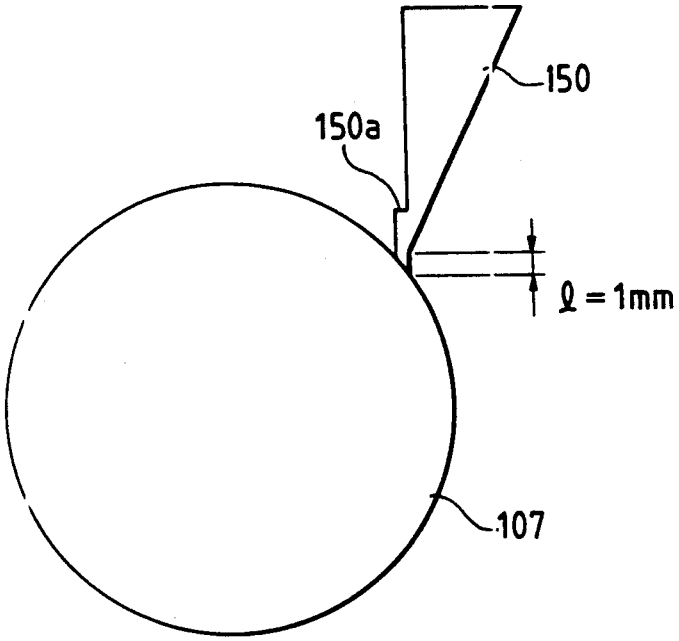
FIG. 20 is a side view showing another example of a guide member of the printer of FIG. 1.
Figure 21:
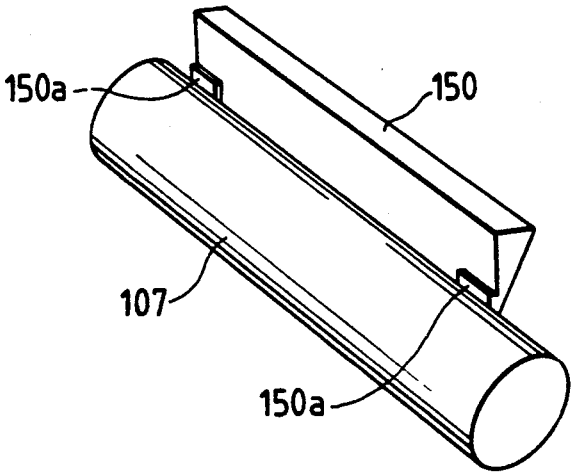
FIG. 21 is a perspective view of the guide member of FIG. 20.

FIGS. 20 and 21 show another example of the sheet guide member.

In FIGS. 20 and 21, spacers 150*a* are attached to both lateral edge portions of the sheet guide member 150, which spacers are abutted against the photosensitive drum 107 at their free ends. Each spacer 150*a* is made of molded material and has a thickness of about 1.5 mm. With this arrangement of the sheet guide member 150, a gap l (about 1 mm) is provided between the sheet guide member 150 and the photosensitive drum 107, and the sheet $P_1$ ($P_2$) is prevented from advancing toward the cleaner 111 by means of the spacers 150*a*, with the result that the jamming of the sheet $P_1$ ($P_2$) can be avoided.

As mentioned above, since the sheet guide member 150 for guiding the sheet to the fixing device 146 is disposed at a downstream side of the photosensitive drum and at the side of the surface of the sheet on which the toner image is transferred, after the transferring operation, the sheet can be surely fed to the fixing device 146 and the jamming of the sheet which may occur immediately after the transferring operation can be reduced considerably.

Next, another embodiment of a laser beam printer incorporating the sheet supply unit 27 of FIG. 2 therein will be explained with reference to FIG. 22.

Figure 22:
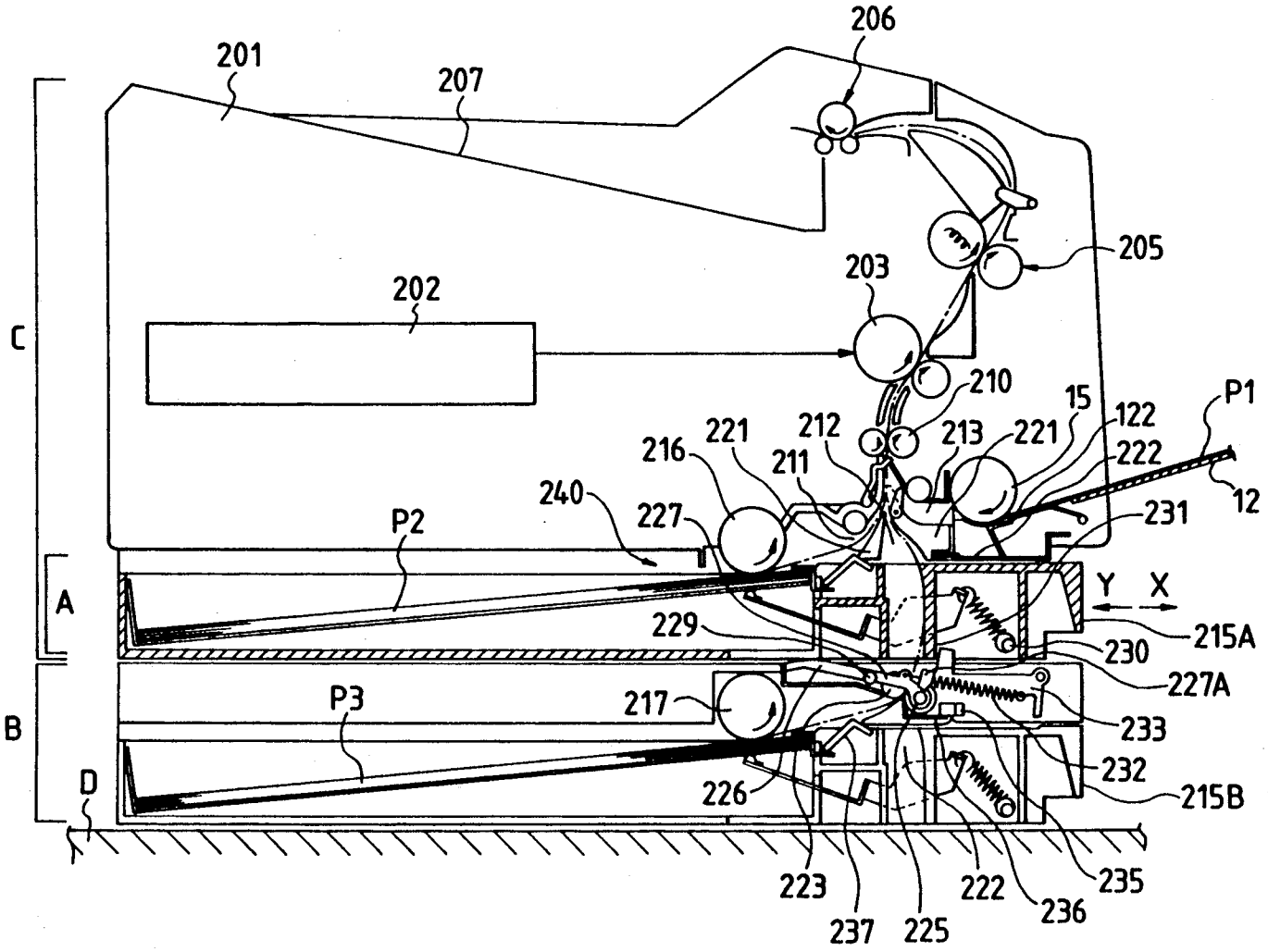
FIG. 22 is an elevational sectional view of another embodiment of a laser beam printer to which the present invention is applied.

As shown in FIG. 22, according to this embodiment, a sheet feeding apparatus A is integrally formed with a laser beam printer C, and a sheet feeding apparatus B is designed as an optional removable unit which is provided independently from the laser beam printer C and can be combined with the printer. According to this embodiment, the sheet feeding apparatus B is rested on an installation base D, and the sheet feeding apparatus A (integral with the laser beam printer C) and the laser beam printer C are positioned and rested on the sheet feeding apparatus B. The positioning of the sheet feeding apparatus A with respect to the sheet feeding apparatus B is effected by fitting projections (not shown) formed on the sheet feeding apparatus B into corresponding holes (not shown) formed in the sheet feeding apparatus A.

The sheet feeding apparatuses A and B each includes a sheet feeder portion 240 having a sheet supply roller 216, 217, and a cassette 215A, 215B which can be inserted into and removed from the sheet feeder portion 240.

A plurality of sheet introduction openings 211, 212, 213 are formed in a bottom surface of a body frame 201 of the printer. As will be described later, the sheet introduction openings 211–213 are disposed so that the sheets entered into these openings can be directed to a pair of regist rollers 210 arranged within the body frame 201. Particularly, the sheet introduction opening 212 serves to receive the sheet supplied from the sheet feeding apparatus B. When the cassette 215A is inserted into the sheet feeding apparatus A in the body frame 201, the cassette 215A is positioned by a pressure shaft 230 so that a guide path 222 formed in the cassette 215A is situated below the sheet introduction opening 212.

The sheet $P_2$ in the cassette 215A is fed into the sheet introduction opening 211 by means of the sheet supply roller 216 and then is fed to the paired regist rollers 210. A latent image is formed on a photosensitive drum 203 by a laser beam scanner 202, and a toner image obtained by developing the latent image is transferred onto the sheet $P_2$ fed from the paired regist rollers 210. After the transferring operation, the sheet $P_2$ is fed to a fixing device 205, where the toner image is fixed to the sheet. Thereafter, the sheet is ejected onto an ejector tray 207 by means of a group of ejector rollers 206.

On the other hand, the sheet $P_3$ in the lower cassette 215B is fed out by the sheet supply roller 217, and then is fed to conveying rollers 223, 225 through a cassette guide 237 and a conveying guide 236. The sheet $P_3$ conveyed by the conveying rollers 223, 225 passes through the guide pass 222 formed in the cassette 215A and enters into the sheet introduction opening 212 to be directed to the paired regist rollers 210 by means of a guide 221 formed within the body frame 201.

An auxiliary guide member 227 is pivotally mounted, at its base portion, on a support shaft of the conveying roller 225, and an additional auxiliary guide member 226 is rotatably (with appropriate resistance) mounted, at its base portion, on a free end of the auxiliary guide member 227 via a support shaft 229. The auxiliary guide members 227, 226 are biased to be rotated in clockwise directions by a spring force of a tension spring 232.

While the sheet $P_3$ supplied from the cassette 215B is being passed through the guide path 222, a cassette locking pawl 233 protrudes upwardly from the sheet feeding apparatus B and abuts against an abutment 231 of the cassette 215A, thereby preventing the extraction of the cassette 215A in a direction X during the sheet $P_3$ supplying operation.

Figure 23:
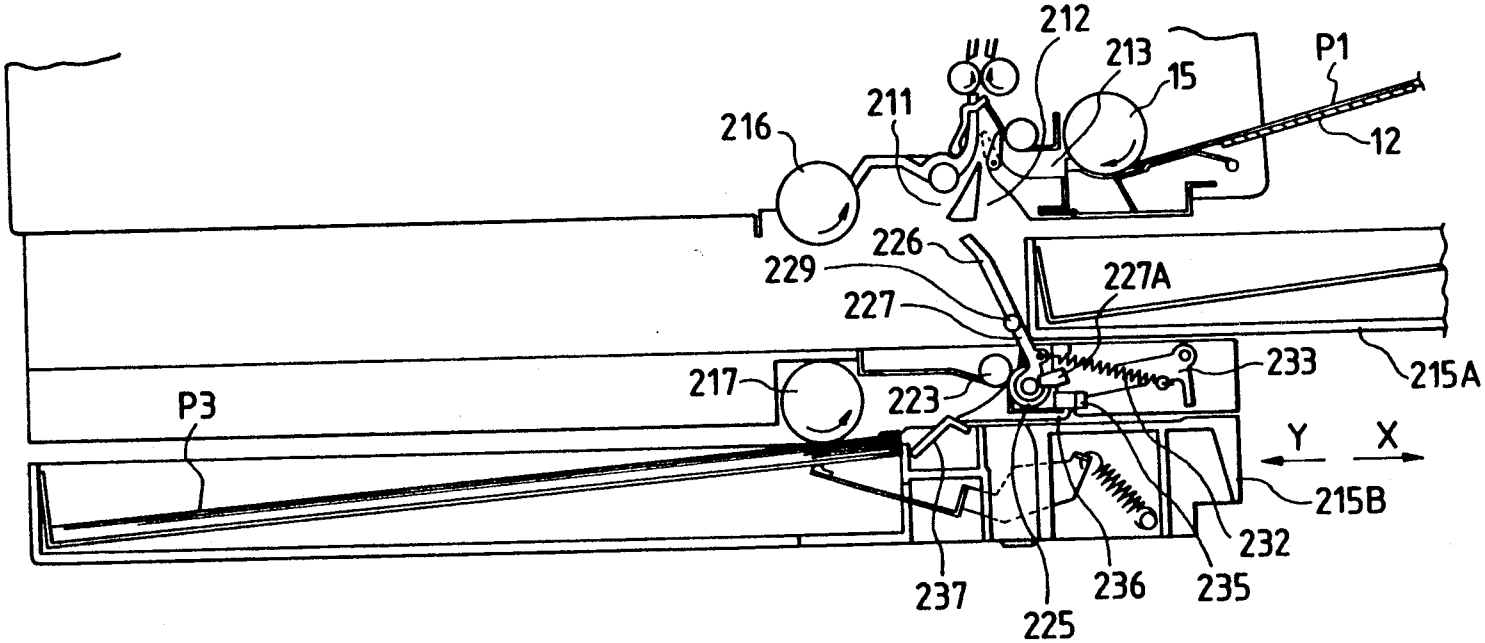
FIG. 23 is an elevational sectional view showing an operation of an auxiliary guide member during the mounting and dismounting of the cassette.

FIG. 23 shows a condition when the cassette 215A is extracted or removed from the sheet feeding apparatus A in the direction X. While the cassette 215A is being extracted from the sheet feeding apparatus A, when a rear end of the cassette passes through the auxiliary guide members 227, 226, these guide members which have been held by the cassette 215A are rotated in the clockwise directions by the spring force of the tension spring 232.

Figure 24:
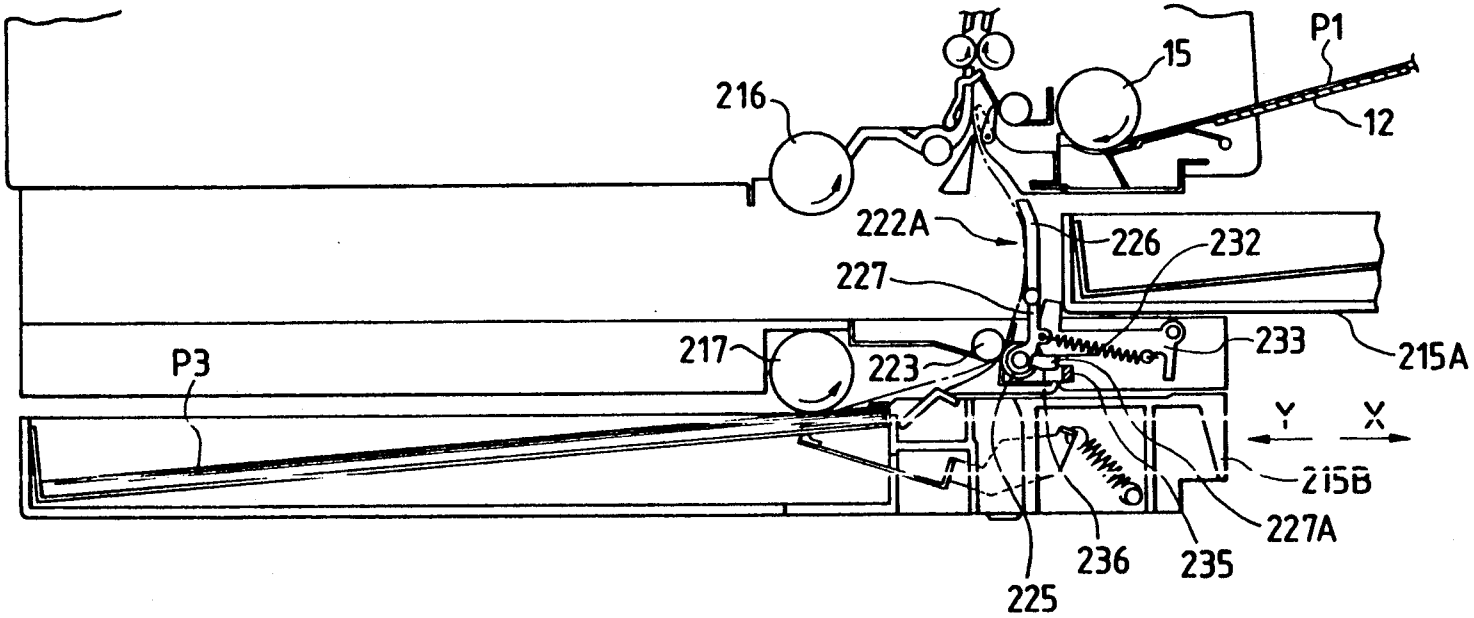
FIG. 24 is an elevational sectional view showing a condition that the sheet is supplied by the auxiliary guide member.
Figure 25:
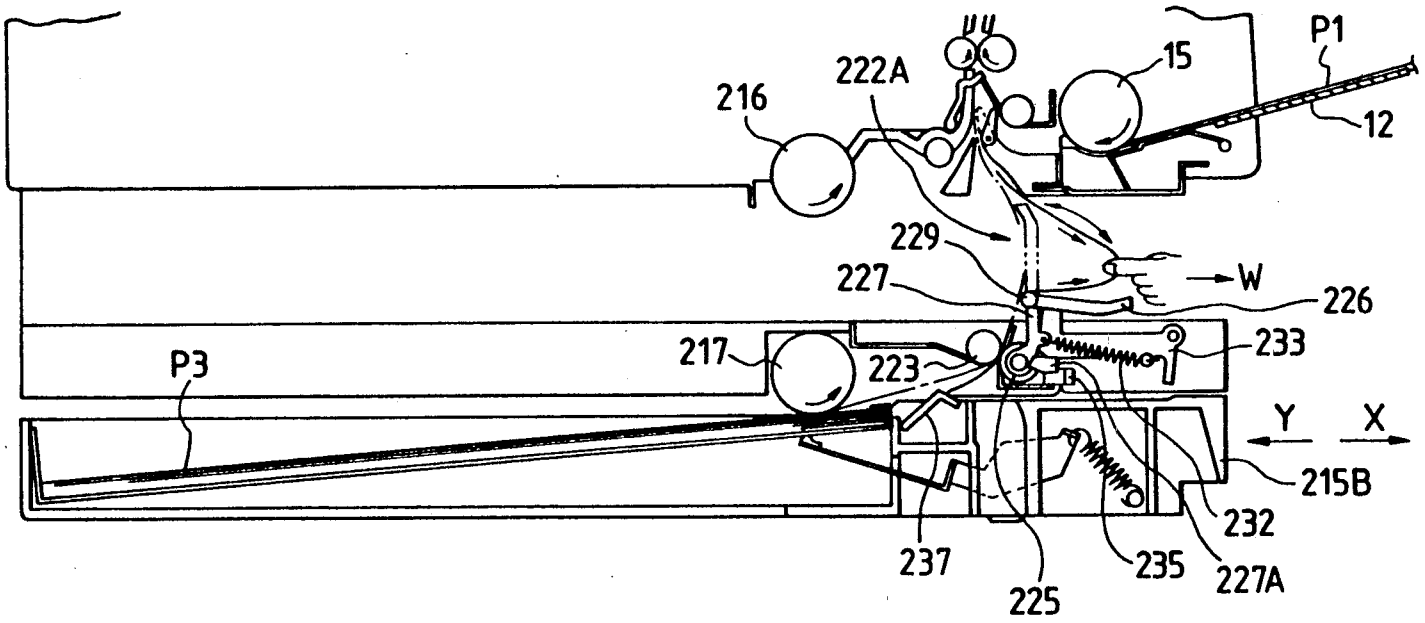
FIG. 25 is an elevational sectional view showing a condition that the sheet is removed when the jamming of the sheet occurs.
Figure 26:
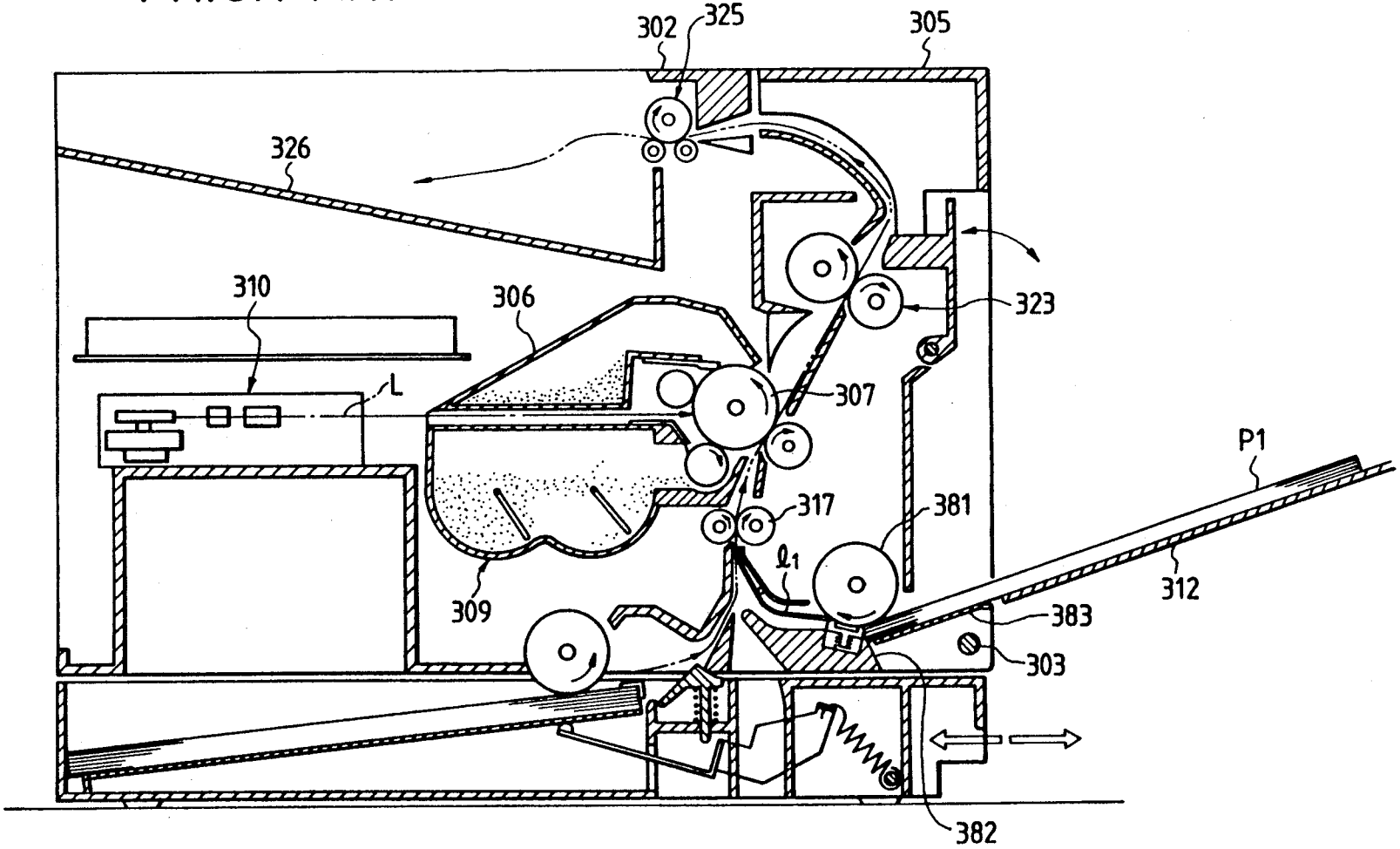
FIG. 26 PRIOR ART
FIG. 26 is an elevational sectional view of a conventional laser beam printer as an example.
Figure 27:
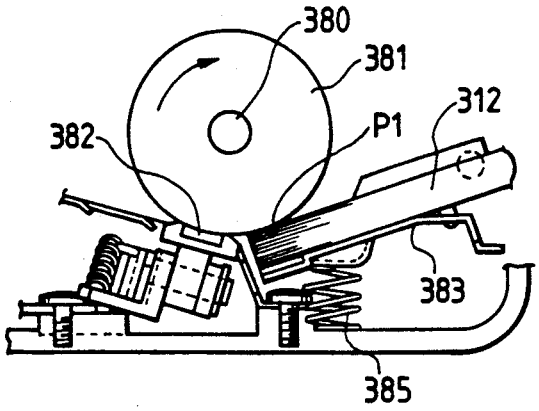
FIG. 27 PRIOR ART
FIG. 27 is an elevational sectional view of a conventional sheet feeding apparatus as an example.
Figure 28:
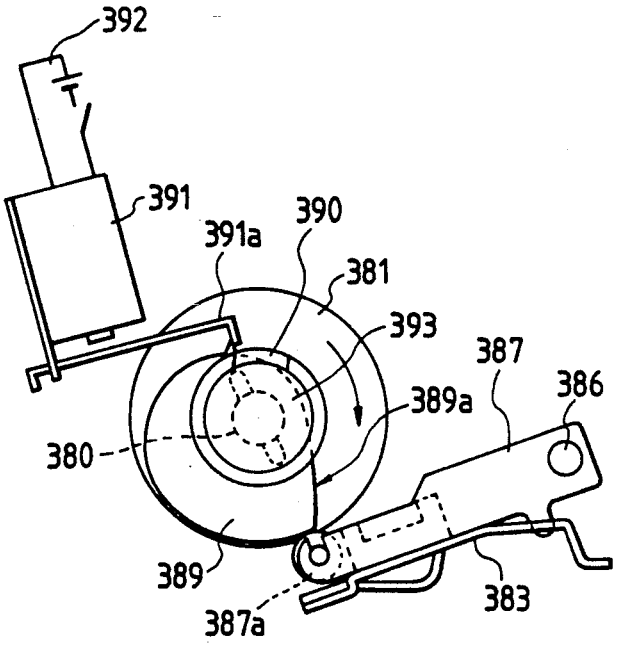
FIG. 28 PRIOR ART
FIG. 28 is a view showing a condition that an intermediate plate is separated from a sheet supply roller by means of a conventional clutch mechanism.
Figure 29:
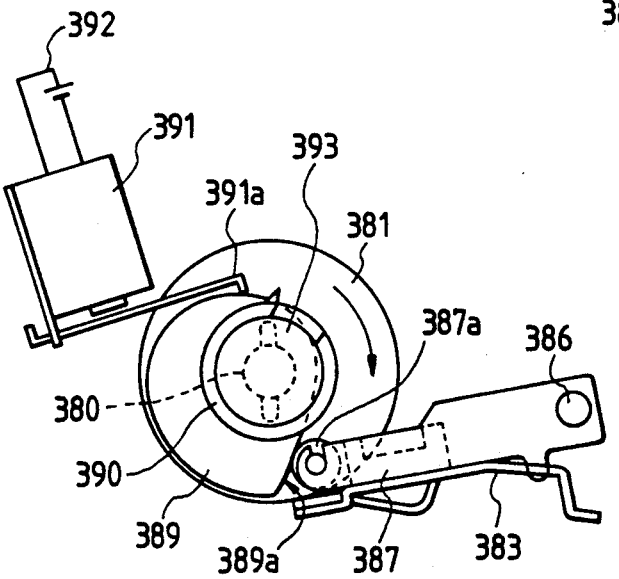
FIG. 29 PRIOR ART
FIG. 29 is a view showing a condition that the intermediate plate is urged against the sheet supply roller by means of the conventional clutch mechanism.

When the rotations of the auxiliary guide members 227, 226 are finished, an auxiliary guide path 222A is formed by the auxiliary guide members 227, 226, as shown in FIG. 24. When the auxiliary guide member 227 is positioned to form the auxiliary guide path 222A, a flag 227A formed integrally with the auxiliary guide member 227 is detected by a sensor 235, thus permitting the supply of the sheet $P_3$ from the cassette 215B.

When the sheet $P_3$ in the cassette 215B is being supplied through the auxiliary guide path 222A, as shown in FIG. 24, the cassette locking pawl 233 is protruded upwardly by means of a driving mechanism (not shown) electrically controlled by the sheet feeding apparatus B. Due to the upward protrusion of the cassette locking pawl 233, during the supplying of the sheet $P_3$, the insertion of the cassette 215A into the sheet feeding apparatus A is prohibited.

While the sheet $P_3$ is being fed via the auxiliary guide members 227, 226, if the sheet $P_3$ is jammed, the jammed sheet $P_3$ can be removed by moving the upper auxiliary guide member 227 toward a direction W to retard this auxiliary guide member to a position shown by the solid line and then by manually pulling the jammed sheet out.

With the above-mentioned arrangement, the following advantages can be obtained.

(1) Since the guide paths are provided in the cassettes for guiding the sheets supplied from a plurality of cassettes, it is possible to shorten the sheet feeding path for the sheet fed from the other direction (from downward direction), thus preventing the supplying of the extra sheet and reducing the possibility of the jamming of the sheet. Further, since the sheet feeding path can be shortened, the number of pairs of conveying rollers for conveying the sheet can be reduced, thus making the apparatus inexpensive.

(2) Since the auxiliary guide path can be provided by the auxiliary guide members, even if the cassette with the guide path does not exist in the laser beam printer (by removing the cassette from the printer), it is possible to supply the sheet from the other cassette.

(3) If any obstacle (for example, cassette, auxiliary guide member or the like) exists in the sheet feeding path, since such obstacle can be detected electrically or mechanically to prohibit the supplying of the sheet, the consumption of the sheets can be avoided.

(4) During the sheet supplying operation, since the erroneous insertion and removal of the cassette can be prevented by extending the projection member (cassette locking pawl) into the guide path of the cassette or the auxiliary guide path formed by the auxiliary guide members, the consumption of the sheets can be avoided.

We claim:

1. A sheet feeding apparatus comprising:

a sheet containing means adapted to support a plurality of sheets and being shiftable between a sheet supplying position and a standby position;

a sheet supply means for feeding out the sheet supported by said sheet containing means at said sheet supplying position;

a driving force transmitting means connected to said sheet supply means and adapted to transmit a driving force from a drive source; and a holding means connected to said driving force transmitting means for shifting said sheet containing means to said sheet supplying position by the driving force transmitted to said sheet supply means and for holding said sheet containing means at said sheet supplying position while the plurality of sheets are being supplied continuously by said sheet supply means.

2. A sheet feeding apparatus according to claim 1, wherein said sheet containing means comprises a pivotable plate for supporting the sheets, and a biasing means for biasing said plate toward said sheet supplying position.

3. A sheet feeding apparatus according to claim 2, wherein said holding means comprises a cam means for regulating said plate at said standby position in opposition to a biasing force of said biasing means and for shifting said plate from said standby position to said sheet supplying position by the biasing force of said biasing means when it receives the driving force from said driving force transmitting means to release the regulation of said plate, and a regulating means for regulating the operation of said cam means to maintain said plate in said sheet supplying position.

4. A sheet feeding apparatus according to claim 3, wherein said regulating means comprises a notched gear connected to said cam means, a gear connected to said driving force transmitting means and capable of meshing with said notched gear, and a stopper means for stopping said notched gear at a predetermined position to regulate the operation of said cam means by positioning said gear at a non-toothed portion of said notched gear.

5. A sheet feeding apparatus according to claim 4, wherein said regulating means includes a detection means for detecting a relative positional relation between said notched gear and said gear, and wherein said stopper means is activated on the basis of the detection of said detection means.

6. A sheet feeding apparatus according to claim 4, wherein said stopper means comprises stoppers formed on said notched gear and an arm engageable with said stoppers, and wherein said notched gear is stopped when said arm is engaged by one of said stoppers.

7. A sheet feeding apparatus according to claim 3, wherein said regulating means comprises a spring clutch interposed between said cam means and said driving force transmitting means, and a circuit means for turning ON/OFF said spring clutch.

8. A sheet feeding apparatus according to claim 1, wherein said driving force transmitting means has a drive shaft, and wherein said sheet supply means and said holding means are disposed on said drive shaft.

9. A sheet feeding apparatus comprising:

a sheet containing means adapted to support a plurality of sheets and being shiftable between a sheet supplying position and a standby position;

a sheet supply means for feeding out the sheet supported by said sheet containing means at said sheet supplying position;

a driving force transmitting means connected to said sheet supply means and adapted to transmit a driving force from a drive source;

a connection means for connecting and disconnecting between said driving force transmitting means and said sheet supply means;

a holding means connected to said driving force transmitting means for shifting said sheet containing means to said sheet supplying position by the driving force transmitted to said sheet supply means and capable of holding said sheet containing means at said sheet supplying position; and a control means for bringing said connection means to a connecting condition to cause said holding means to hold said sheet containing means at said sheet supplying position while the plurality of sheets are being supplied continuously by said sheet supply means.

10. A sheet feeding apparatus according to claim 9, wherein said control means changes said connection means from a disconnecting condition that the driving force is not transmitted to said sheet supply means to the connecting condition that the driving force is transmitted to said sheet supply means, after said sheet containing means has been maintained in said sheet supplying position by means of said holding means.

11. A sheet feeding apparatus according to claim 9, wherein said sheet containing means comprises a pivotable plate for supporting the sheets, and a biasing means for biasing said plate toward said sheet supplying position.

12. A sheet feeding apparatus according to claim 11, wherein said holding means comprises a cam means for regulating said intermediate plate at said standby position in opposition to a biasing force of said biasing means and for shifting said plate from said standby position to said sheet supplying position by the biasing force of said biasing means when it receives the driving force from said driving force transmitting means to release the regulation of said plate, and a regulating means for regulating the operation of said cam means to maintain said plate in said sheet supplying position.

13. A sheet feeding apparatus according to claim 12, wherein said regulating means comprises a notched gear connected to said cam means, a gear connected to said driving force transmitting means and capable of meshing with said notched gear, and a stopper means for stopping said notched gear at a predetermined position to regulate the operation of said cam means by positioning said gear at a non-toothed portion of said notched gear.

14. A sheet feeding apparatus according to claim 9, wherein said connection means comprises a spring clutch interposed between said sheet supply means and said driving force transmitting means, and a circuit means for turning ON/OFF said spring clutch.

15. A sheet feeding apparatus according to claim 9, wherein said driving force transmitting means has a drive shaft, and wherein said sheet supply means, said connection means and said holding means are disposed on said drive shaft.

16. An image forming system comprising:

a sheet containing means adapted to support a plurality of sheets and being shiftable between a sheet supplying position and a standby position;

a sheet supply means for feeding out the sheet supported by said sheet containing means at said sheet supplying position;

a driving force transmitting means connected to said sheet supply means and adapted to transmit a driving force from a drive source;

a holding means connected to said driving force transmitting means for shifting said sheet containing means to said sheet supplying position by the driving force transmitted to said sheet supply means and capable of holding said sheet containing means at said sheet supplying position while the plurality of sheets are being supplied continuously by said sheet supply means;

a separating means for separating the sheets fed by said sheet supply means one by one; and an image forming means for forming an image on the sheet separated by said separating means.

17. An image forming system according to claim 16, further including a connection means for connecting and disconnecting between said driving force transmitting means and said sheet supply means.

18. An image forming system according to claim 17, further including a control means for changing said connection means from a disconnecting condition that the driving force is not transmitted to said sheet supply means to a connecting condition that the driving force is transmitted to said sheet supply means after said sheet containing means has been maintained in said sheet supplying position by means of said holding means.

19. An image forming system according to claim 16, further including a second sheet containing means, a common sheet feeding path provided by joining sheet feeding paths for feeding the sheets from the respective sheet containing means to said image forming means at a junction, and a pivotable guide means disposed at said junction for guiding the sheets to one of said sheet feed paths.

20. An image forming system according to claim 19, wherein said guide means is retarded toward the sheet feeding path which is not used at that time and is held in a retarded position.

* * * * *

UNITED STATES PATENT AND TRADEMARK OFFICE

CERTIFICATE OF CORRECTION

PATENT NO. : 5,201,873

DATED : April 13, 1993

INVENTOR(S) : KIKUCHI et al.

It is certified that error appears in the above-indentified patent and that said Letters Patent is hereby corrected as shown below:

On title page, item [56] insert

--*Attorney, Agent, or Firm*
Fitzpatrick, Cella, Harper & Scinto--.

COLUMN 8

Line 11, "is" should read --are--.
Line 28, "inputing" should read --inputting--.
Line 65, "reprenishment" should read --replenishment-- and "P1" shold read --$P_1$--.

COLUMN 10

Line 59, "sinde" should read --since--.

COLUMN 11

Line 50, "a" should be deleted.
Line 66, "position" should read --position,--.

COLUMN 12

Line 26, "As" should read --An--.

UNITED STATES PATENT AND TRADEMARK OFFICE

CERTIFICATE OF CORRECTION

PATENT NO. : 5,201,873

DATED : April 13, 1993

INVENTOR(S) : Yutaka Kikuchi, et al

It is certified that error appears in the above-identified patent and that said Letters Patent is hereby corrected as shown below:

Column 13, line 67, "inputed" should read --inputted--

Signed and Sealed this

Twenty-second Day of March, 1994

*Attest:*

Bruce Lehman

BRUCE LEHMAN

*Attesting Officer*

*Commissioner of Patents and Trademarks*